US006769637B2

(12) United States Patent
Nakamura et al.

(10) Patent No.: US 6,769,637 B2
(45) Date of Patent: Aug. 3, 2004

(54) INJECTOR MODULE, INJECTOR ELECTRIC BLOCK BODY, INJECTOR MAIN BODIES TO BE USED FOR THE SAME, AND IGNITION COIL DEVICE MODULE

(75) Inventors: Kazushige Nakamura, Nagoya (JP); Isao Isshiki, Nagoya (JP); Takao Nozaki, Nagoya (JP); Fumiyoshi Tanigawa, Yokkaichi (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 270 days.

(21) Appl. No.: 09/994,628

(22) Filed: Nov. 28, 2001

(65) Prior Publication Data

US 2002/0066443 A1 Jun. 6, 2002

(30) Foreign Application Priority Data

Dec. 4, 2000 (JP) ..... 2000-368152
Feb. 22, 2001 (JP) ..... 2001-046325

(51) Int. Cl.[7] ..... F02M 51/00
(52) U.S. Cl. ..... 239/585.1; 123/456
(58) Field of Search ..... 239/86–96, 533.2–533.12, 239/585, 585.1, 585.3, 585.4–585.5; 123/456, 468, 470, 472; 439/130, 652

(56) References Cited

U.S. PATENT DOCUMENTS 5,030,116 A * 7/1991 Sakai et al. ..... 439/130
5,086,743 A * 2/1992 Hickey ..... 123/468
5,127,382 A * 7/1992 Imoehl ..... 123/470
6,019,928 A 2/2000 Fujitani et al.
6,053,148 A * 4/2000 Glovatsky et al. ..... 123/470
6,612,290 B2 * 9/2003 Nozaki et al. ..... 123/456

FOREIGN PATENT DOCUMENTS

JP 3011048 B2 12/1999

* cited by examiner

*Primary Examiner*—Gene Mancene
*Assistant Examiner*—Thach H Bui
(74) *Attorney, Agent, or Firm*—Oliff & Berridge, PLC

(57) ABSTRACT

Electromagnetic coil parts 25 and wiring 26 for connection to the electromagnetic coil parts 25 are installed inside injector electric block body 20 in which injector main body housing holes 21*h* are made in accordance with injector mounting holes Eh of the engine body E side, and injector main bodies 30 having valve parts 35 are inserted into the injector main body housing holes 21*h*, whereby the valve parts 35 are driven to open and close by means of exciting and non-exciting operation of the electromagnetic coil parts 25. Further, an ignition coil device module is provided with ignition coil devices 102 provided corresponding to a plurality of combustion chambers of an engine, respectively, wherein connection surface base portions at which connecting terminals are exposed are provided on one-side surface of each ignition coil device 102.

15 Claims, 18 Drawing Sheets

50
51
31h
21
20B
21a
21b
30
10
23
29
29h
26B

INJECTOR MODULE, INJECTOR ELECTRIC BLOCK BODY, INJECTOR MAIN BODIES TO BE USED FOR THE SAME, AND IGNITION COIL DEVICE MODULE

BACKGROUND OF THE INVENTION

1. Field of the Invention

The present invention relates to an injector module to be used for an internal-combustion engine of a vehicle or the like and injector electric block body and injector main bodies to be used for the same.

Further, the present invention relates to an ignition coil device module to be used for an internal-combustion engine for a vehicle or the like.

2. Related Art

Conventionally, an injector for injecting fuel to combustion chambers of an internal-combustion engine is comprised of a needle valve and an electromagnetic coil for electromagnetically driving the needle valve to open and close being unified with each other, generally. Then, the fuel injecting orifice side ends of injectors are inserted into the injector mounting holes at the engine head side, and delivery pipes are attached to the fuel intake side ends of the injectors and fastened to the engine head side with bolts or the like, whereby the injectors are installed, fixed, and sandwiched between the engine head and delivery pipes.

Furthermore, exciting current conducting harness terminals for each electromagnetic coil are connected to each injector thus installed and fixed via connectors.

Further, recently, electronic control has been widely employed for engine systems of vehicles and the like, and various techniques have been employed in which ignition coil devices (igniter-combined ignition coils) and injectors are also provided in the ignition systems and fuel systems of the engine corresponding to the combustion chambers, and the ignition coil devices and injectors are controlled by an engine control unit to control the fuel injection amount and ignition timing for each combustion chamber.

As a wiring form for the ignition coil devices in such a conventional type of engine room, a structure has been employed in which ignition coil devices are attached to the corresponding positions of the cylinder head cover of the engine by fastening with bolts and the like, and harness terminals drawn out from the engine control unit are connected to the ignition coil devices, respectively by connectors.

[Problems to be Solved]

However, in the abovementioned injectors, connectors of the harness terminals must be connected to the injectors in the vicinity of the engine head, so that efficiency of the assembly work to the engine head is poor.

In addition, since harnesses formed of electric wire bundles are used as the wiring members between the engine control unit and injectors, and the harness terminals and injectors are connected to each other by connectors, the entire injector is very heavy.

Further, according to the conventional structure, since a system is employed in which the harness terminals drawn out from the engine control unit are connected, respectively, to the ignition coil devices attached to the engine side in the engine room, this system is troublesome and assembly work efficiency is very poor.

SUMMARY OF THE INVENTION

Therefore, a first object of the invention is to provide an injector module which shows excellent assembly work efficiency to an engine body and can be reduced in weight, and an injector electric block and injector main bodies to be used for the same.

Further, a second object of the invention to provide an ignition coil device module in which assembly work efficiency to an engine is improved.

[Means for Solving the Problems]

In order to solve the abovementioned problems, an injector module according to Aspect 1 of the invention is provided with a plurality of injector parts corresponding to combustion chambers of an engine and fuel injecting control of the injector parts is made by an engine control unit, wherein, said injector module comprises: an injector electric block body which is formed so that, inside an injector frame body with injector main body housing holes made in the frame body at positions corresponding to injector mounting holes at the engine body side, electromagnetic coil parts are installed so as to be wound around the inner circumferences of the injector main body housing holes, and wiring for connection to the electromagnetic coil parts are installed; and injector main bodies which are formed into roughly columnar shapes and have valve parts to adjust the timing of fuel injection from fuel injecting orifices, columnar parts which are provided in succession to the valve parts to feed fuel supplied from fuel intakes linearly, and movable magnetic bodies which can reciprocate between predetermined open and close positions for opening and closing the valve parts and are pressed toward the close positions, wherein the injector main bodies are inserted into the injector main body housing holes in a posture in which the movable magnetic bodies are movable to the open positions against the pressing forces in accordance with excitation of the electromagnetic coil parts and are movable to the close positions due to the pressing forces in accordance with non-excitation of the electromagnetic coil parts.

As described in Aspect 2 of the invention, the injector module may be constructed so that fixing core portions are provided at the centers of the electromagnetic coil parts, the movable magnetic bodies are provided to be extensions of the fixing core portions, auxiliary core portions are provided around the outer circumferences of the movable magnetic bodies, and outer circumferential core portions are provided around the outer circumferences of the electromagnetic coil parts, whereby a magnetic circuit is formed so that magnetic fluxes generated by power supply to the electromagnetic coil parts passes the fixing core portions, movable magnetic bodies, auxiliary core portions, and outer circumferential core portions and then reach the fixing core portions again.

As described in Aspect 3, nonmagnetic bodies may be interposed between the fixing core portions and outer circumferential core portions.

As described in Aspect 4, in place of or in addition to the outer circumferential core portions provided around the outer circumferences of the electromagnetic coil parts, inter-injector core portions may be provided between the injector main body housing holes of the injector frame body to form a magnetic circuit in which magnetic fluxes generated by power supply to the electromagnetic coil parts pass through the adjacent inter-injector core portions.

As described in Aspect 5, the injector electric block body may be unified with a delivery pipe.

As described in Aspect 6, a construction may be employed in which pressure-welding terminals are connected to the winding ends of the electromagnetic coil parts, and coated single-core wires are used for wiring, and the ends of the wires are pressure-welded to the pressure-welding terminals.

The injector electric block body of the injector module described in Aspect 7 is provided with a plurality of injector parts corresponding to combustion chambers of an engine, where fuel injecting control of the injector parts is made by an engine control unit, and comprises: an injector frame body with injector main body housing holes made in the frame body at positions corresponding to injector mounting holes at the engine body side; electromagnetic coil parts which are disposed to be wound around the inner circumferences of the injector main body housing holes to electromagnetically open and close the valve parts of the injector main bodies to be inserted into the injector main body housing holes; and wiring which is installed inside the injector frame body for connection to the electromagnetic coil parts.

The injector main bodies of the injector module described in Aspect 8 are provided with a plurality of injector parts corresponding to combustion chambers of an engine, where fuel injecting control at the injector parts is made by an engine control unit, and are formed into roughly columnar shapes having fuel intakes on one side and fuel injecting holes on the other side, and comprises: valve parts which are provided at the fuel injecting hole sides to adjust the injection timing of fuel supplied through the fuel intakes; and movable magnetic bodies which can reciprocate between predetermined open and close positions for opening and closing the valve parts, and are pressed towards the close positions, and open the valve parts by moving to the open positions against the pressing forces by use of excitation of the electromagnetic coil parts provided at the injector mounting hole sides of the injector electric block body side.

Further, in an ignition coil device module in which ignition coil devices are provided corresponding to a plurality of combustion chambers of an engine, and ignition control of the ignition coil devices is made by an engine control unit, the ignition coil devices are electrically connected at predetermined pitches by flexible wiring with flexibility and unified with each other, whereby ignition control is made through the flexible wiring.

Furthermore, the flexible wiring may be a flexible printed board.

Furthermore, the pitches of electrical connection of the ignition coil devices to the flexible wiring may be made longer than the provision pitches of the ignition coil devices for the engine.

Furthermore, the ignition coil device module may be structured so that, on one surface of each ignition coil device, connection surface base portions at which the electrical connecting terminals are exposed are provided, and fixed cover members to be fixed in a detachable manner at each connection surface base portion so as to surround the outsides of connecting terminals at the connection base end portions are provided, and by fixing the fixed cover members to the connection surface base portions, the flexible wiring is sandwiched and fixed between the fixed cover members and connection surface base portions, wiring conductors at portions in the flexible wiring thus sandwiched and fixed corresponding to the connecting terminals of the connection surface base portions are exposed, and the connecting terminals and wiring conductors are electrically connected to each other by the sandwiching fixation.

In addition, between the connection surface base end portions and fixed cover members, annular sealing members may be provided to surround the outsides of the connecting portions between the connecting terminals and wiring conductors.

Furthermore, when the flexible wiring is sandwiched and fixed by fixing the fixed cover members to the connecting terminals, pressing elastic materials for pressing the exposed portions of the wiring conductors against the connecting terminals may be provided on the fixed cover members.

Furthermore, a cylinder head cover in which the flexible wiring and fixed cover members are installed may be provided.

DETAILED DESCRIPTION OF THE PREFERRED EMBODIMENTS

Hereinafter, an injector module of an embodiment of this invention is explained.

Figure 1:
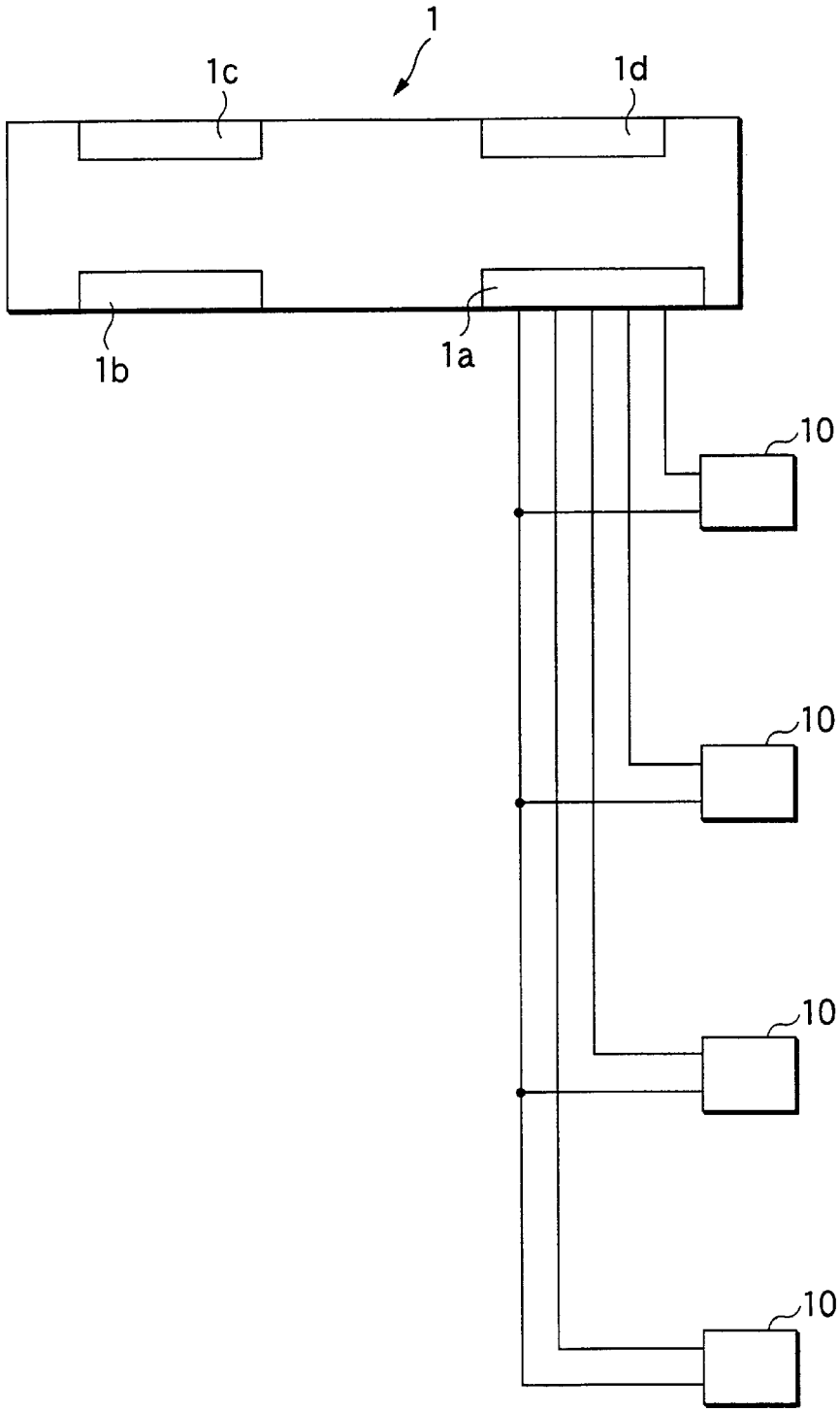
FIG. 1 is a block diagram showing the electric construction of the engine control system.
Figure 2:
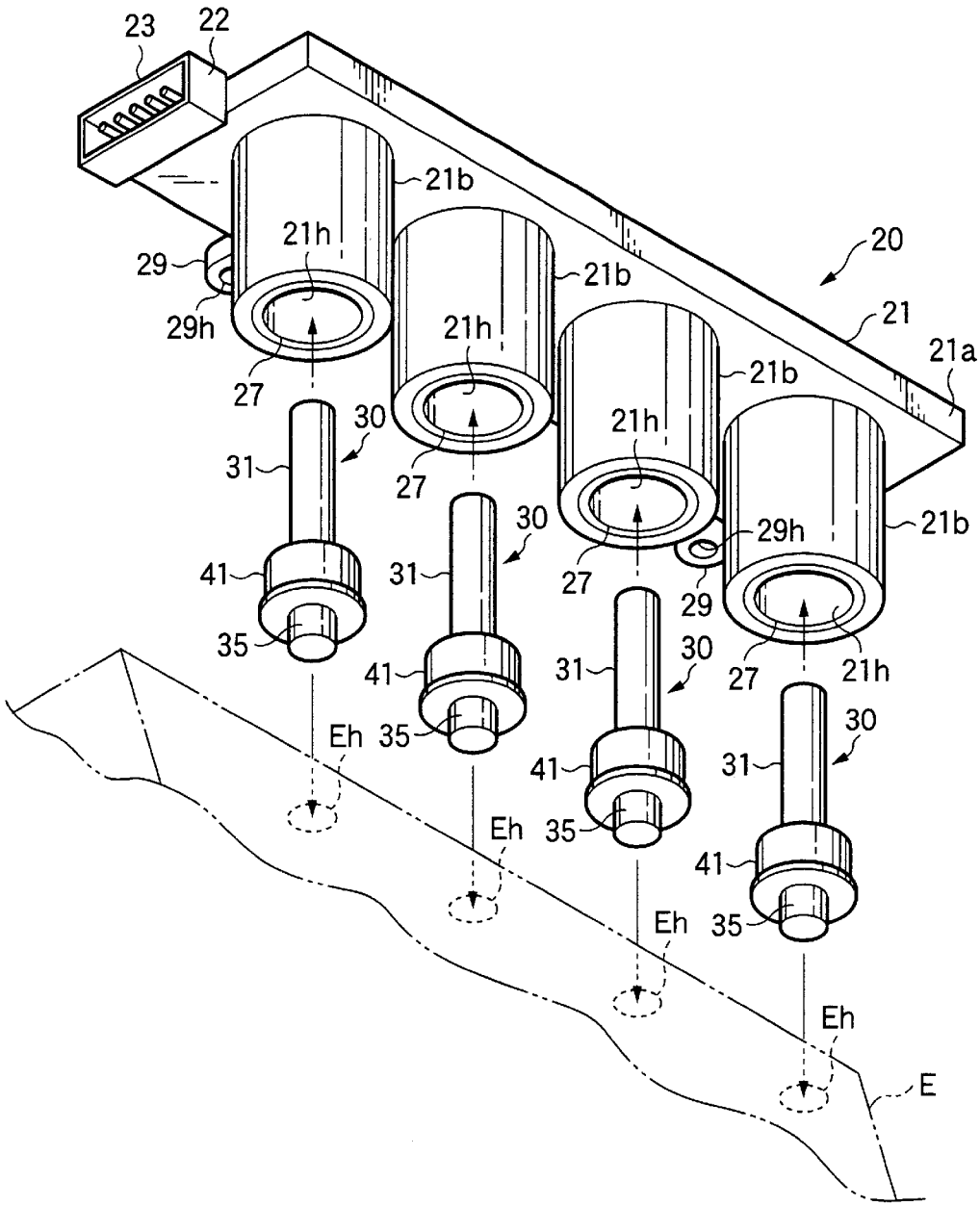
FIG. 2 is an exploded perspective view showing the injector module of the embodiment of the invention.
Figure 3A:
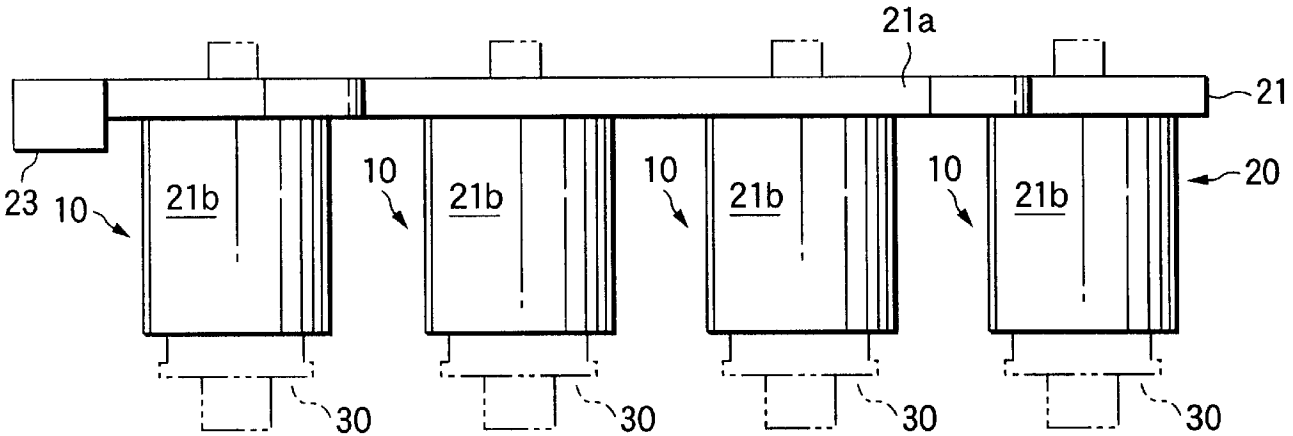
FIG. 3(*a*) is a front view of the injector electric block body, and FIG. 3(*b*) is a plan view of the injector electric block body.
Figure 3B:
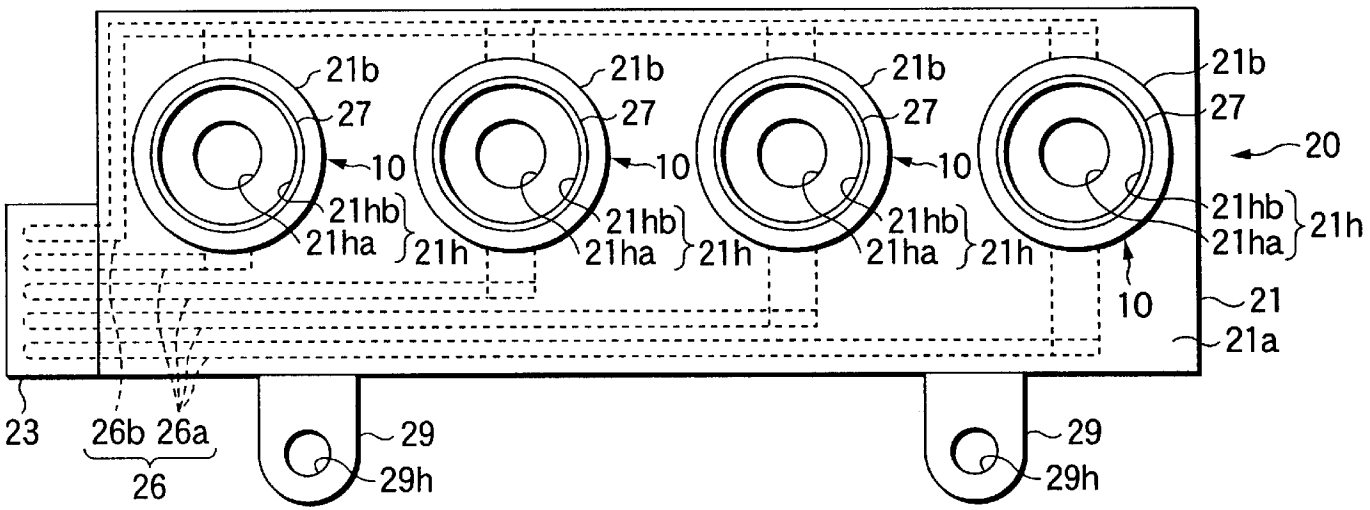

This injector module is constructed as shown in FIG. 1 so that, in an engine control system for making fuel injecting control for a plurality of injector parts 10 provided in accordance with combustion chambers of an engine by using engine control unit (unit called EFI-ECU or the like) 1, a coil part and a valve part of each injector 10 are separated from each other, and the wiring structure for the coil part is unified with the coil part.

Incidentally, the engine control unit 1 is connected to the injector parts 10 via input/output part 1*a,* and then to power supply Systems such as various sensors and batteries and various parts such as junction blocks inside a vehicle, and further connected to ignition coil devices via input/output parts 1*b* through 1*d,* and controls the timing of fuel injection of the injector parts 10 based on various detection signals from the various sensors. In this embodiment, a construction with four injector parts 10 is employed for an assumed 4-cylinder engine, however, the number of injector parts may be properly changed depending on the number of cylinders of an engine.

As shown in FIG. 2 through FIG. 5, this injector module comprises injector electric block body 20 in which electromagnetic coil parts of injector parts 10 and the wiring structure to the electromagnetic coils are unified and a plurality of injector main bodies 30 having valve parts of the injector parts 10.

The injector electric block body 20 is constructed so that, in injector frame body 21 with injector main body housing holes 21*h* made in the frame body at positions corresponding to injector mounting holes Eh at the engine body E side, electromagnetic coil parts 25 are installed and wound around the inner circumferences of the injector main body housing holes 21*h,* and wiring 26 for connection to the electromagnetic coil parts 25 is installed.

Concretely, the injector frame body 21 is formed from a nonmagnetic insulating material such as an insulating resin or the like, and in this embodiment, the frame body is constructed so that a plurality of projecting columnar parts 21*b* shaped into rough columns are projectedly provided in accordance with injector mounting holes Eh at the lower surface side of plate-shaped part 21*a* shaped into a rough rectangle in a plan view.

The injector main body housing holes 21*h* are formed to perforate the portions of the injector frame body 21 at which the projecting columnar parts 21*b* are formed, and the upper sides of the housing holes are formed to be small diameter portions 21*ha* into which the columnar parts 31 of the injector main bodies 30 can be inserted, and the lower sides of the housing holes are formed to be large diameter portions 21*hb* into which auxiliary core portions 41 of the injector main bodies 30 to be described later can be housed. The injector main bodies 30 can be inserted into the injector main body housing holes 21*h* from below.

The electronic coil parts 25 are obtained by winding electric wires with insulative coatings such as enamel or the like around bobbins 25*b* so as to have donut shapes with inner diameters that are the same as or larger than the inner diameters of the small diameter portions 21*ha,* and are disposed in a buried manner so as to surround the inner circumferences of the small diameter portions 21*ha* at portions of the small diameter portions 21*ha* close to the large diameter portions. That is, the electromagnetic coil parts 25 are disposed so as to be wound around the inner circumferences of the injector main body housing holes 21*h,* and when a current is supplied to each electromagnetic coil part 25, magnetic fluxes generated from the coil parts 25 pass through the movable magnetic bodies 34 (described later) of the injector main bodies 30, which are disposed at least inside the injector main body housing holes 21*h,* and attract the movable magnetic bodies 34 toward the inside of the electromagnetic coil parts 25.

The wiring 26 includes four power supply wires 26*a* for separately supplying power to the electromagnetic coil parts 25 and ground wires 26*a* used commonly for the electromagnetic coil parts 25, and is comprised of bus bars formed into thin bands from a conductive material such as metal or the like and bare round conductors whose sections are roughly round. The power supply wires 26*b* and ground wires 26*b* are buried in plate-shaped part 21*a* of the injector frame body 21 with a predetermined pattern together with the electromagnetic coil parts 25 by means of insert molding or the like, and to one side end of each power supply wire 26*a* and one side end of each ground wire 26*b,* in the vicinity of the corresponding electromagnetic coil parts 25, terminals attached to the winding ends drawn out from the electromagnetic coil parts 25 are welded by fusing and electrically connected. The wiring 26 is buried in the injector frame body 21 by means of insert molding or the like together with the electromagnetic coil parts 25, so that sufficient waterproofness can be obtained between the wiring 26 and electromagnetic coil parts 25 without employing other special waterproof structures.

Furthermore, connector housing part 22 is formed at one side of the injector frame body 21, and the other end portions of the power supply wires 26*a* and ground wires 26*b* are projectedly provided as connector terminals inside the connector housing part 22 to form connector part 23. Then, by connecting the connectors at wire harness terminals, whose illustrations are omitted, drawn out from the engine control unit 1 to the connector part 23, the electromagnetic coil parts 25 and engine control unit 1 are electrically connected to each other, and excitation/non-excitation control for the electromagnetic coil parts 25 is made by supply and interruption of a fuel injection control current from the engine control unit 1.

At one side of the injector electric block 20, as attaching members for attachment and fixation to the engine main body E side, attaching pieces 29 with attaching holes 29*h* are projectedly provided. By screw-fastening bolts or the like inserted into the attaching holes 29*h* of the attaching pieces 29 into the screw holes of the engine body E side, the injector electric block body 20 is attached and fixed to the engine body E in a predetermined posture in a condition where the injector main bodies 30 are inserted into the injector main body housing holes 21*h*.

The injector main bodies 30 are formed into roughly columnar shapes, and comprised of valve parts 35, columnar parts 31 provided linearly in succession to the valve parts 35, and movable magnetic bodies 34 which move by interlocking with the opening and closing operations of the valve parts 35.

The columnar parts 31 have roughly columnar shapes, fuel intakes 31*h* are formed at the upper ends thereof, and fuel passages 31*p* penetrating along the axial direction are formed inside. The fuel intake sides of the columnar parts 31 are formed in a manner enabling them to be inserted and connected to fuel supply ports 51 of the delivery pipe 50 side. Fuel flowing in the delivery pipe 50 is divided at the fuel supply ports 51 and supplied to the fuel intakes 31*h,* and further pass through the fuel passages 31*p* and supplied to the valve parts 35. O-rings O1 of rubber or the like are compressed and interposed between the upper outer circumferential surfaces of the columnar parts 31 and inner circumferential surfaces of the fuel supply ports 51 to prevent fuel leakage flowing between the upper outer circumferential surfaces of the columnar parts 31 and inner circumferential surfaces of the fuel supply ports 51.

The valve parts 35 are connected to the lower end sides of the columnar parts 31, and adjust the injection timing of fuel supplied via the columnar parts 31, and fuel injecting orifices 35*h* are formed at the lower end sides of the valve parts. The fuel injecting orifice 35*h* side ends of the valve parts 35 are formed in a manner enabling them to be inserted and connected into the injector mounting holes Eh of the engine main body E side, and fuel injected from the fuel injecting orifices 35*h* is supplied to the combustion chambers of the engine main body E side via an intake manifold. O-rings O2 of rubber or the like are compressed and interposed between the outer circumferential surfaces of the valve parts 35 and the inner circumferential surfaces of the fuel injecting orifices 35*h* to prevent water entrance into the combustion chambers from the surfaces.

Concretely, the valve parts 35 are provided with tapered nozzles 37 inside cylindrical parts 36 opening at the lower sides, and spherical valves 38 at the front end sides of the nozzle 37. The spherical valves 38 are formed to be spherical so as to close the front end side openings of the nozzles 37, and fixed and supported at front end positions inside the cylindrical parts 36 by unillustrated supporting means. The nozzles 37 are supported at a depth inside the cylindrical parts 36 so as to advance and withdraw between predetermined advance positions (see FIG. 4), at which said front end openings are closed by pressing the spherical valves 38, and predetermined withdrawal positions (see FIG. 5) at which said openings are opened by withdrawing to the base end sides from the advance positions. At advanceable and withdrawable supporting parts 39, fuel passages 39*p* are formed which are communicated with the fuel passages 31*p*, whereby fuel supplied through the fuel passages 31*p* is fed into the nozzles 37 and injected from the front end sides of the nozzles 37. At this time, if the nozzles 37 advance to the advance positions, the front end openings of the nozzles 37 are closed by the spherical valves 38 to stop fuel injection from the nozzles 37. On the other hand, if the nozzles 37 withdraw to the withdrawal positions, the front end openings of the nozzles 37 are opened, and fuel injection from the nozzles 37 is carried out.

Movable magnetic bodies 34 are formed from a magnetic material such as silicon steel or the like in a manner in that the bodies can reciprocate between predetermined close positions P1 (see FIG. 4) and predetermined open positions P2 (see FIG. 5) for opening and closing the valve parts 35 and are pressed toward the close positions P1.

Figure 4:
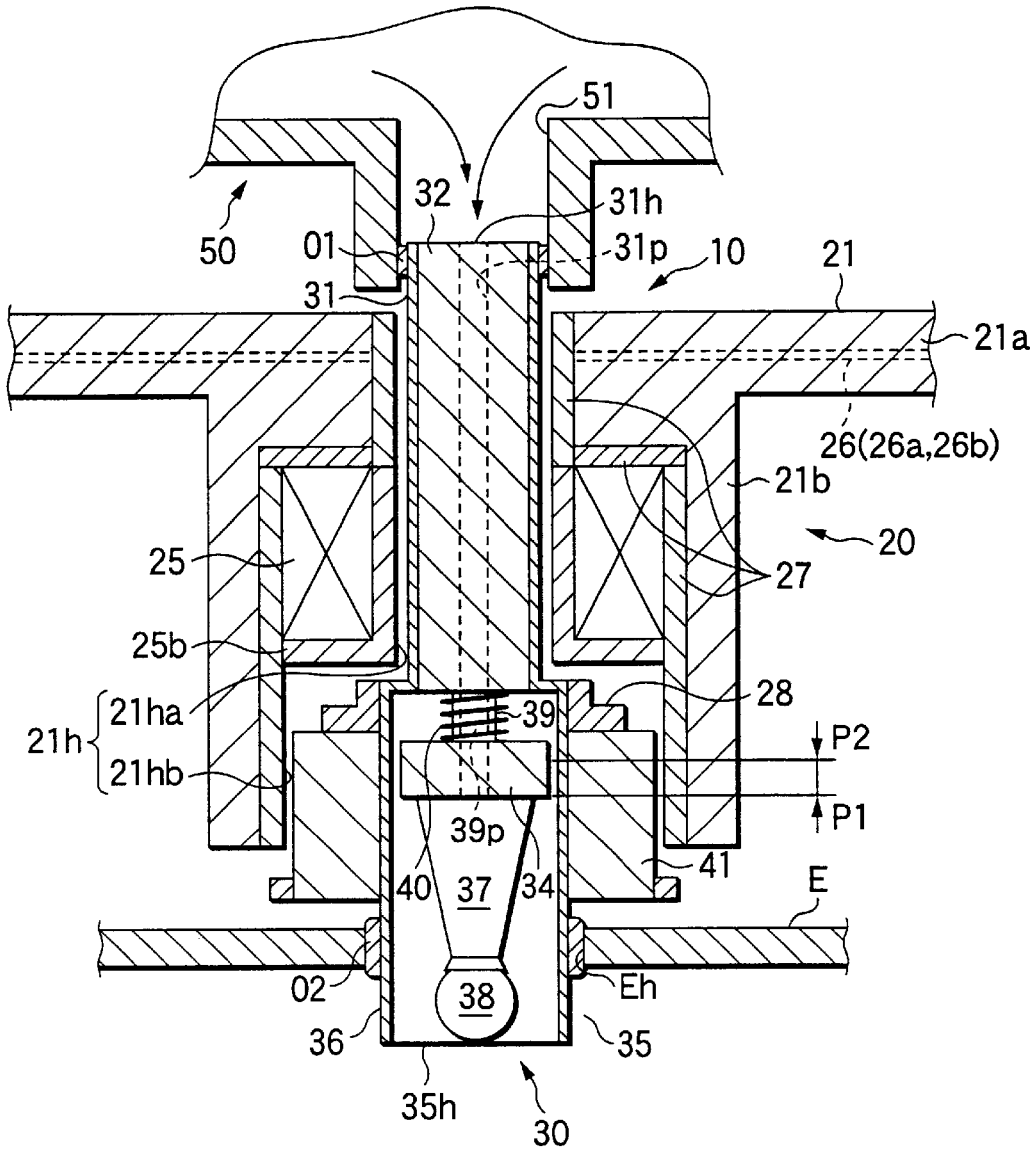
FIG. 4 is a sectional view showing the closed condition of the valve part of the injector module.
Figure 5:
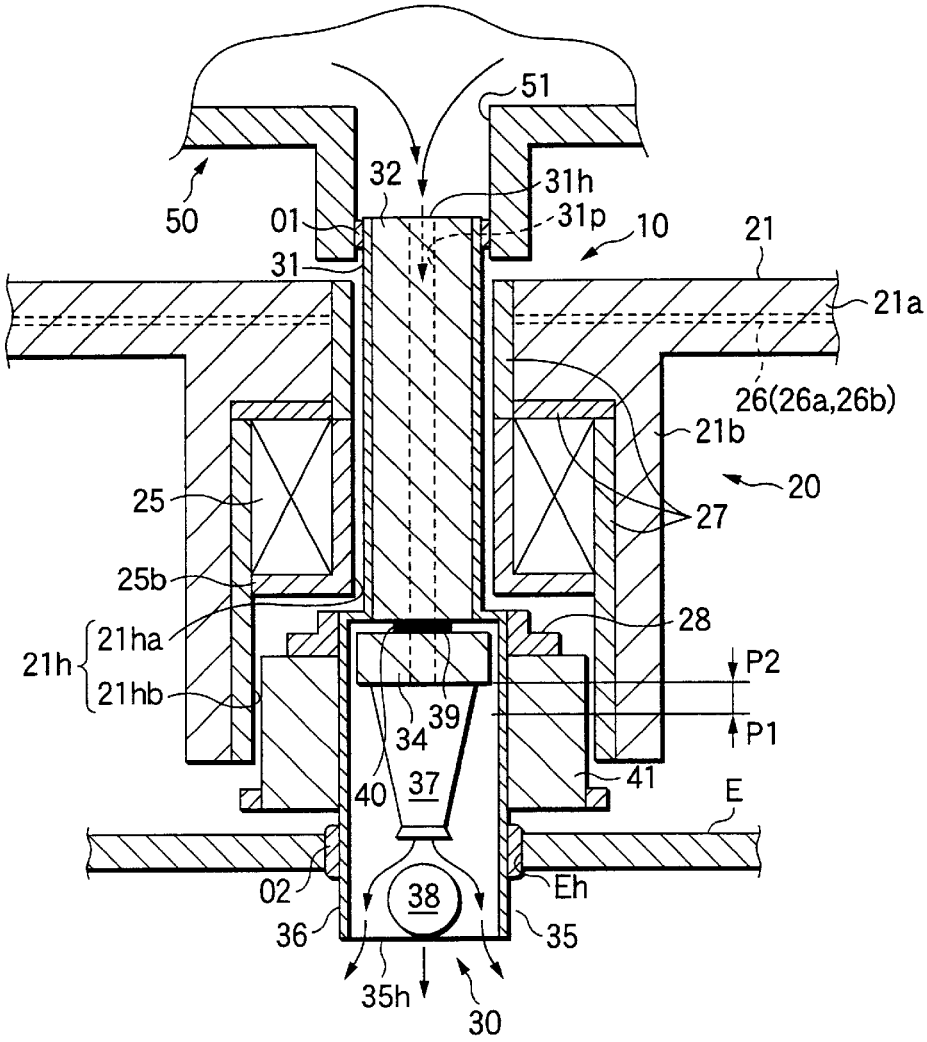
FIG. 5 is a sectional view showing the open condition of the valve part of the injector module.

Concretely, movable magnetic bodies 34 are provided and fixed to the base ends of the nozzles 37 in the valve parts 35 so that the nozzles 37 move to the withdrawal positions by interlocking with the movement of the movable magnetic bodies 34 to the open positions P2 and then open the valve parts 35 (see FIG. 4), and the nozzles 37 move to the advance positions by interlocking with the movement of the movable magnetic bodies 34 to the close positions P1 and then close the valve parts 35 (see FIG. 5). In addition, the movable magnetic bodies 34 may be disposed outside the valve parts 35 in a manner enabling them to reciprocate, and the movable magnetic bodies 34 and nozzles 37 may be connected to each other by predetermined connecting structures so that the movable magnetic bodies 34 interlock with the nozzles 37.

At the advanceable and withdrawable supporting parts 39, coil springs 40 as pressing means are interposed between the columnar parts 31 and nozzles 37 in a compressed manner, whereby the movable magnetic bodies 34 are pressed toward the close positions P1.

Furthermore, the injector main bodies 30 are inserted into injector main body housing holes 21*h* in a posture so that the movable magnetic bodies 34 can move to the open positions P2 by means of excitation of the electromagnetic coil parts 25 against the pressing forces of the coil springs 40, and the movable magnetic bodies 34 can move to the close positions P1 by means of the pressing forces of the coil springs 40 in accordance with non-excitation of the electromagnetic coil parts 25.

That is, in this injector module, as described later, when assembling the module to the engine body E side, the columnar parts 31 are disposed inside the small diameter portions 21*ha* and the valve parts 35 are disposed inside the large diameter portions 21*hb*, and the injector main bodies 30 are inserted into the injector main body housing holes 21*h* (see FIG. 4 and FIG. 5), whereby the injector parts 10 are assembled. At this time, the valve parts 35 are disposed at positions shifting downward from the insides of the electromagnetic coil parts 25 along the axial core directions, so that the movable magnetic bodies 34 inside the valve parts 35 are also disposed at positions shifting downward from the inside of the electromagnetic coil parts 25 along the axial core directions. Therefore, when the electromagnetic coil parts 25 are excited by power supply in a condition where the movable magnetic bodies 34 are pressed to the close positions P1, magnetic fluxes generated therefrom pass the insides of the movable magnetic coil parts 34, and the movable magnetic bodies 34 are attracted toward the insides of the electromagnetic coil parts 25 via the auxiliary core portions 41, that is, attracted to the open positions P2. Also, in this condition, when power supply to the electromagnetic coil parts 25 is interrupted and the condition is changed into a non-excited condition, by the pressing forces of the coil springs 40, the movable magnetic bodies 34 move to the close positions P1.

According to the abovementioned construction, the opening and closing drive of the valve parts 35 becomes possible by excitation and non-excitation of the electromagnetic coil parts 25 in principle, however, in this embodiment, in order to make the opening and closing drive of the valve parts 35 more accurate, the following construction is employed.

That is, as shown in FIG. 4 and FIG. 5, in the injector parts 10, fixing core portions 32 made from a magnetic material are provided at the centers of the electromagnetic coil parts 25, the movable magnetic bodies 34 are disposed at the lower end sides of the fixing core portions 32, auxiliary core portions 41 made from a magnetic material are provided around the outer circumferences of the movable magnetic bodies 34, and furthermore, outer circumferential core portions 27 made from a magnetic material are provided around the outer circumferences of the electromagnetic coil parts 25, whereby a magnetic circuit is formed so that magnetic fluxes generated in accordance with power supply to the electromagnetic coil parts 25 pass through the fixing core portions 32, movable magnetic bodies 34, auxiliary core portions 41, and outer circumferential core portions 27 in order and then reach the fixing core portions 32 again.

Concretely, in the injector main bodies 30, columnar fixing core portions 32 are installed inside so as to extend along the center axes of the electromagnetic coil parts 25 within the columnar parts 31, and the fuel passages 31*p* are formed along the center axes of the fixing core portions 32. Also, annular auxiliary core portions 41 are provided around the outer circumferences of the columnar parts 36 of the cylindrical parts 36 of the valve parts 35.

Furthermore, regarding the injector main body housing holes 21*h*, around the outer circumferences of the electromagnetic coil parts 25 and at the outsides of the upper and lower ends of the electromagnetic coil parts 25, cylindrical outer circumferential core portions 27 made from a magnetic material such as iron plates are provided around the inner circumferences of the injector main body housing holes 21*h*.

Thereby, a magnetic circuit is formed in which magnetic fluxes generated due to excitation of the electromagnetic coil parts 25 are passed from the lower end sides to upper end sides of the outer circumferential core portions 27 through the movable magnetic bodies 34 and auxiliary core portions 41 from the lower ends of the fixing core portions 32 and then reach the insides of the fixing core portions 32 again.

Between the fixing core portions 32 and outer circumferential core portions 27, non-magnetic bodies 28 are interposed. The non-magnetic bodies 28 are formed from a non-magnetic material such as austenite steel or martensite steel, which prevents a temporary connecting condition between the fixing core portions 32 and outer circumferential core portions 27 and prevents magnetic fluxes from the fixing core portions 32 from directly entering the auxiliary core portions 41 without passing through the movable magnetic bodies 34.

Concretely, the non-magnetic bodies 28 are formed to be roughly annular, and attached to the upper end face sides of the outer circumferential core portions 27 so as to surround the upper ends of the cylindrical parts 36 of the valve parts 35.

In this embodiment, the annular auxiliary core portions 41 also have a function for releasing the attracted condition of the movable magnetic bodies 34 upward due to residual magnetism after power supply to the electromagnetic coil parts 25 is interrupted.

Furthermore, in this injector module, since the injector electric block body 20 and injector main bodies 30 may be combined so that the movable magnetic bodies 34 move to the open positions P2 due to the magnetic action resulted by excitation of the electromagnetic coil parts 25, the injector main bodies 30 are not inserted and fixed into the injector main body housing holes 21*h* of the injector electric block body 20, and the outer circumferential shapes of the injector main bodies 30 are formed to be slightly smaller than the inner circumferential shapes of the injector main body housing holes 21*h,* and in a condition where slight spaces (for example, 0.5 mm) are left between the outer circumferences of the injector main bodies 30 and the inner circumferences of the injector main body housing holes 21*h,* the injector main bodies 30 are housed and disposed inside the injector main body housing holes 21*h*. Furthermore, the injector main bodies 30 are sandwiched and fixed between the portions at which the injector mounting holes Eh at the engine body E side are formed and the delivery pipe 50, and the injector electric block body 20 is fixed to the engine body E side via the attaching pieces 29. Thereby, tolerances in the manufacturing dimensions required for the injector main bodies 30, injector electric block body 20 and the like become wide, and after assembling to the engine body E, tolerances for thermal contraction to be generated at the injector electric block body 20 and injector main bodies 30 become wide.

Next, the processes for assembling this injector module to the engine body E side are explained.

First, the valve parts 35 of the injector main bodies 30 are inserted and connected to the injector mounting holes Eh at the engine body E side. Next, the columnar parts 31 are disposed inside the small diameter portions 21*ha* and the valve parts 35 are disposed inside the large diameter portions 21*hb,* and then the injector main bodies 30 are inserted into the injector main body housing holes 21*h* of the injector electric block body 20. In this condition, when the injector electric block body 20 is attached and fixed to the engine body E side via the attaching pieces 29, while the injector main bodies 30 are maintained in the condition where they are inserted and disposed inside the injector main body housing holes 21*h,* the injector parts 10 are assembled, whereby the injector module is assembled to the engine body E side.

Thereafter, the upper ends of the columnar parts 31 of the injector main bodies 30 that project upward from the injector main body housing holes 21*h* of the injector electric block body 20 are inserted and connected to the fuel supply ports 51 of the delivery pipe 50 side, respectively.

The operation of the injector module thus assembled is explained.

First, in the non-operating condition of the engine, fuel supply to the delivery pipe 50 is stopped and power supply to the electromagnetic coil parts 25 is interrupted, and the movable magnetic bodies 34 are positioned at the close positions P1 and valve parts 35 are in the closed condition (see FIG. 4).

Then, when the engine is started, fuel supply to the delivery pipe 50 by an unillustrated fuel pump is started, and at the injector parts 10, by supply and interruption of a fuel injection control current from the engine control unit 1, excitation and non-excitation of the electromagnetic coil parts 25 are controlled, and control of fuel injection from predetermined valve parts 35 is made.

That is, focusing attention on one predetermined injector part 10, when power is supplied to the electromagnetic coil part 25, the electromagnetic coil part 25 is excited and the movable magnetic body 34 moves to the open position P2 against the pressing force of the coil spring 40 and the valve part 35 opens by interlocking with the movement. Thereby, fuel to be fed into the delivery pipe 50 is branched at the fuel supply port 51 and fed to the injector main body 30 side, passes through the fuel passage 31*p,* and then is injected from the fuel injection orifice 35*h* of the valve part 35 and supplied to a combustion chamber of the engine body E side via the intake manifold. Thereafter, at said one injector part 10, when power supply to the electromagnetic coil part 25 is interrupted, the electromagnetic coil part 25 changes into a non-excited condition and the movable magnetic body 34 moves to the close position P1 due to the pressing force of the coil spring 40, and interlocking with this, the valve part 35 closes and fuel supply to the combustion chamber is stopped.

The injector module thus constructed comprises an injector electric block body 20 formed so that, in an injector frame body 21 with injector main body housing holes 21*h* made in the frame body at positions corresponding to injector mounting holes Eh of the engine body E side, electromagnetic coil parts 25 are installed and wound around the inner circumferences of the injector main body housing holes 21*h,* and wiring 26 for connection to the electromagnetic coil parts 25 is installed; valve parts 35 formed into roughly columnar shapes to adjust the injection timing of fuel from the fuel injection orifices 35*h;* and injector main bodies 30 having columnar parts 31 which are linearly provided in succession to the valve parts 35 to feed fuel supplied from fuel intakes 31*h* to the valve parts 35, and movable magnetic bodies 34 which can reciprocate between predetermined open positions P2 and predetermined close positions P1 for opening and closing the valve parts 35 and are pressed toward the close positions P1, wherein the injector main bodies 30 are inserted into the injector main body housing holes 21*h* in a posture in which the movable magnetic bodies 34 can move to the open positions P2 due to excitation of the electromagnetic coil parts 25 against the pressing forces, and can move to the close positions P1 due to the pressing forces in accordance with non-excitation of the electromagnetic coil parts. Therefore, connection of harness terminal connectors to each injector as in the conventional example is not necessary, and therefore, work efficiency of assembly to the engine body E side and waterproofness are excellent.

In addition, different from the conventional example, the harness terminals and injectors are not connector-connected by using harnesses formed of electric wire bundles as wiring members between the engine control unit and injectors, so that reduction in weight can be achieved, accordingly.

Furthermore, fixing core portions 32 are provided and positioned at the centers of the electromagnetic coil parts 25, movable magnetic bodies 34 are provided to be extensions of the fixing core portions 32, auxiliary core portions 41 are provided around the outer circumferences of the movable magnetic bodies 34, and outer circumferential core portions 27 are provided around the outer circumferences of the electromagnetic coil parts 25, whereby a magnetic circuit is formed so that magnetic fluxes generated in accordance with power supply to the electromagnetic coil parts 25 pass through the fixing core portions 32, movable magnetic bodies 34, auxiliary core portions 41, and outer circumferential core portions 27 and then reach the fixing core portions 32 again. Thereby, the magnetic flux density at the movable magnetic bodies 34 becomes greater and can attract the movable magnetic bodies 34 to the open positions P2, and therefore, opening and closing operations can be made more accurate.

Furthermore, since non-magnetic bodies 28 are interposed between the fixing core portions 32 and outer circumferential core portions 27, magnetic fluxes generated from the fixing core portions 32 are prevented from directly entering the auxiliary core portions 41 without passing through the movable magnetic bodies 34, whereby more magnetic fluxes can be made to pass through the movable magnetic bodies 34, and the movable magnetic bodies 34 can be more securely moved to the open positions P2 by excitation of the electromagnetic coil parts 25.

Figure 6:
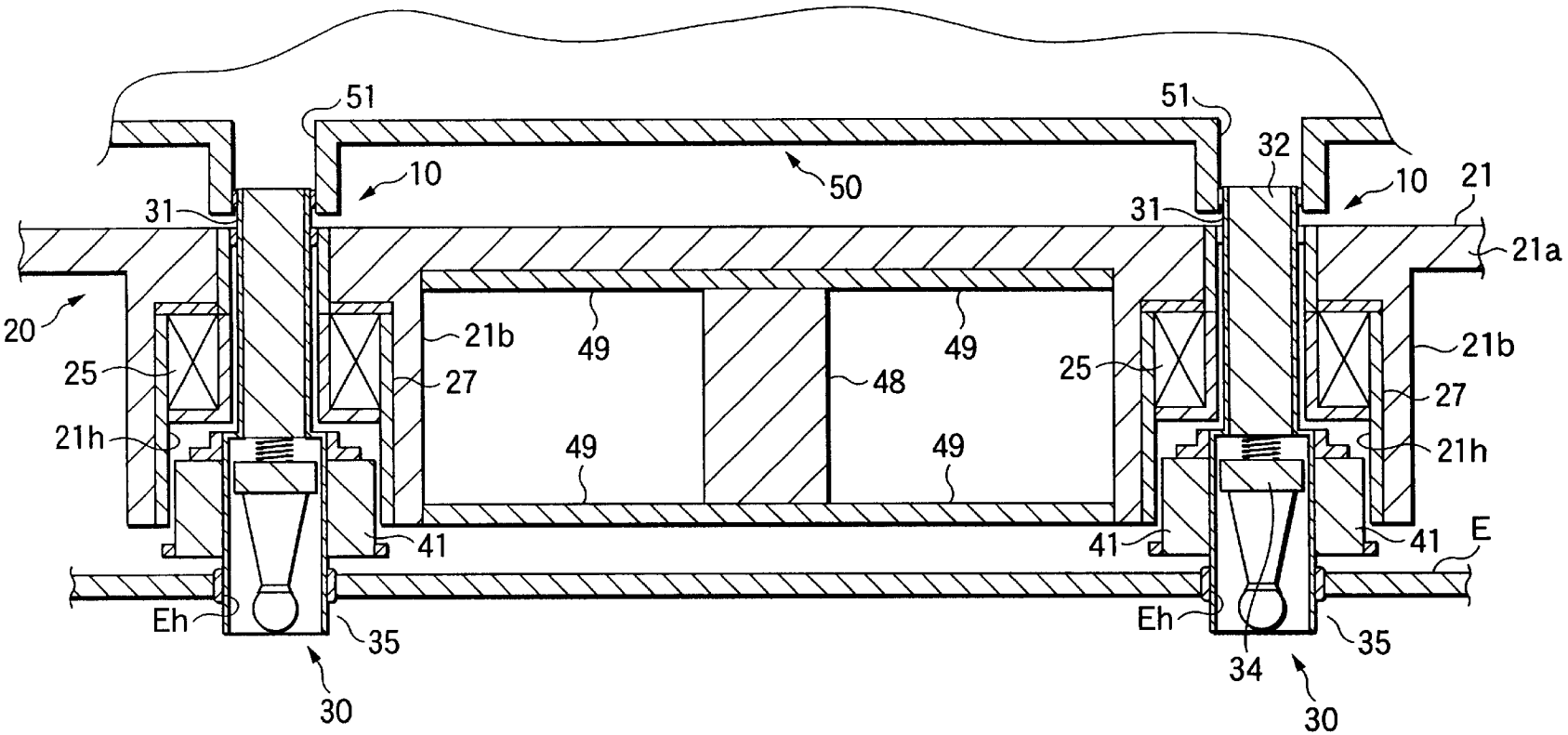
FIG. 6 is a sectional view showing the injector module of the modified example.

As shown in FIG. 6, in place of or in addition to the outer circumferential core portions 27 provided around the outer circumferences of the electromagnetic coil parts 25, between the injector main body housing holes 21*h* of the injector frame body 21, inter-injector core portions 48 may be provided to form a magnetic circuit in which magnetic fluxes generated in accordance with power supply to the electromagnetic coil parts 25 pass through the adjacent inter-injector core portions 48.

Concretely, at the lower surface side of the injector frame body 21 of the injector electric block body 20, columnar inter-injector core portions 48 made from a magnetic material (bolts or the like can be used) are provided between the injector main body housing holes 21*h,* and extended core portions 49 formed of iron plates or the like are extended from the base ends and front ends of the inter-injector core portions 48 toward the upper and lower portions of the adjacent electromagnetic coil parts 25. Thereby, a magnetic circuit is formed in which magnetic fluxes generated in accordance with power supply to the electromagnetic coil parts 25 pass through the fixing core portions 32, movable magnetic bodies 34, auxiliary core portions 41, lower-side extended core portions 49, inter-injector core portions 48, and upper-side extended core portions 49 and then reach the fixing core portions 32 again, and the magnetic flux density at the movable magnetic bodies 34 increases, whereby it becomes possible to more securely move the movable magnetic bodies 34 to the open positions P2 by means of excitation of the electromagnetic coil parts 25.

Figures 7A, 7B, 7C:
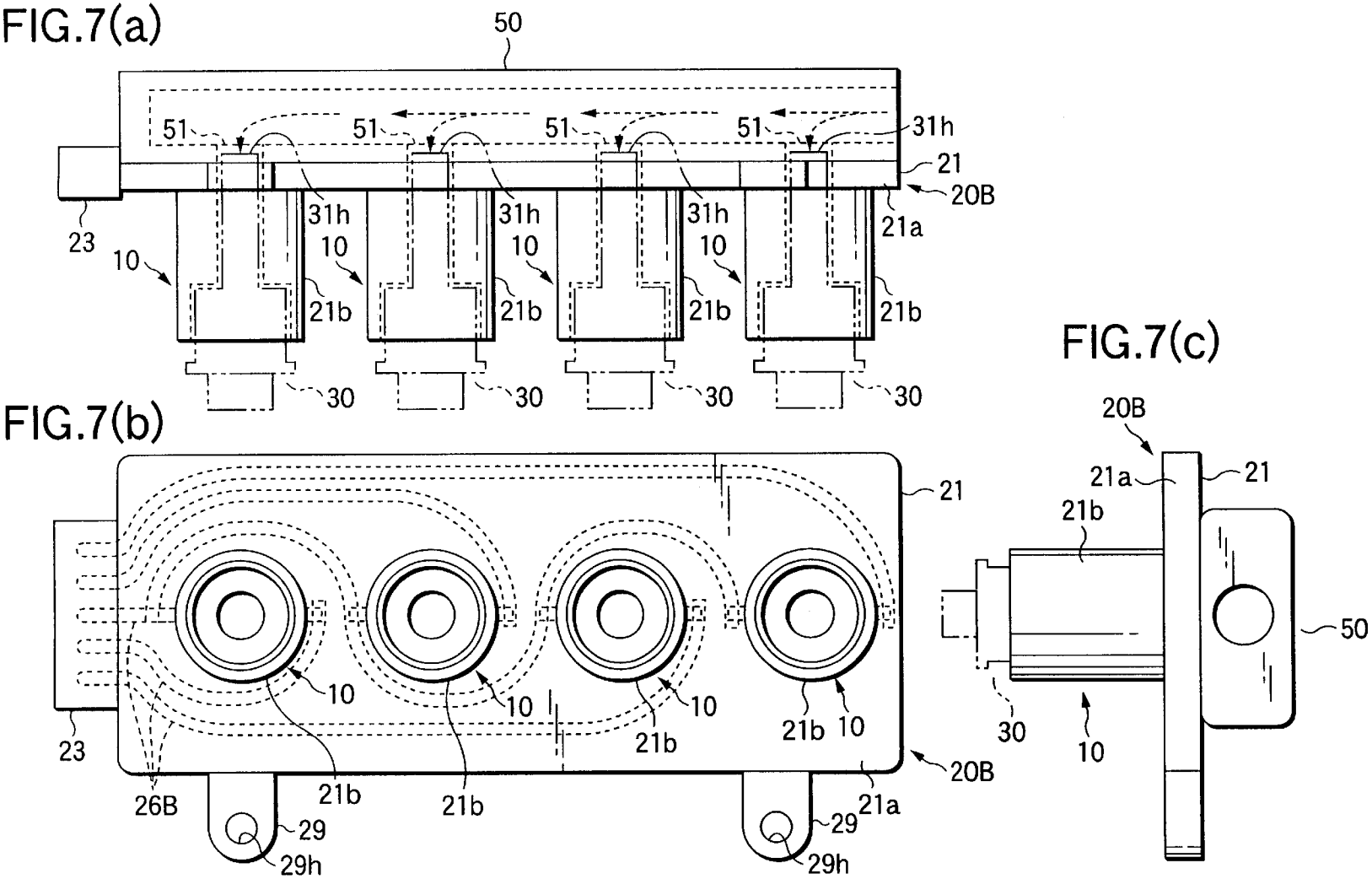
FIG. 7(*a*) is a front view of the injector electric block body of the same modified example, FIG. 7(*b*) is a plan view of the same injector electric block body, and FIG. 7(*c*) is a side view of the same injector electric block body.

Furthermore, as shown in FIG. 7, injector electric block body 20B may be unified with the delivery pipe 50.

Concretely, the injector frame body 21 of the injector electric block body 20B and the delivery pipe 50 may be integrally formed from a heat-resistant resin so that the injector main body housing holes 21*h* at the injector frame body 21 side and the fuel supply ports 51 at the delivery pipe 50 side are communicated with each other. The injector electric block body 20B are substantially similar to the abovementioned injector electric block body 20 except for the wiring layout of wiring 26B.

Thus, if the injector electric block body 20B and delivery pipe 50 are unified with each other, assembly of the block body to the engine body E side becomes easier.

Figure 8A:
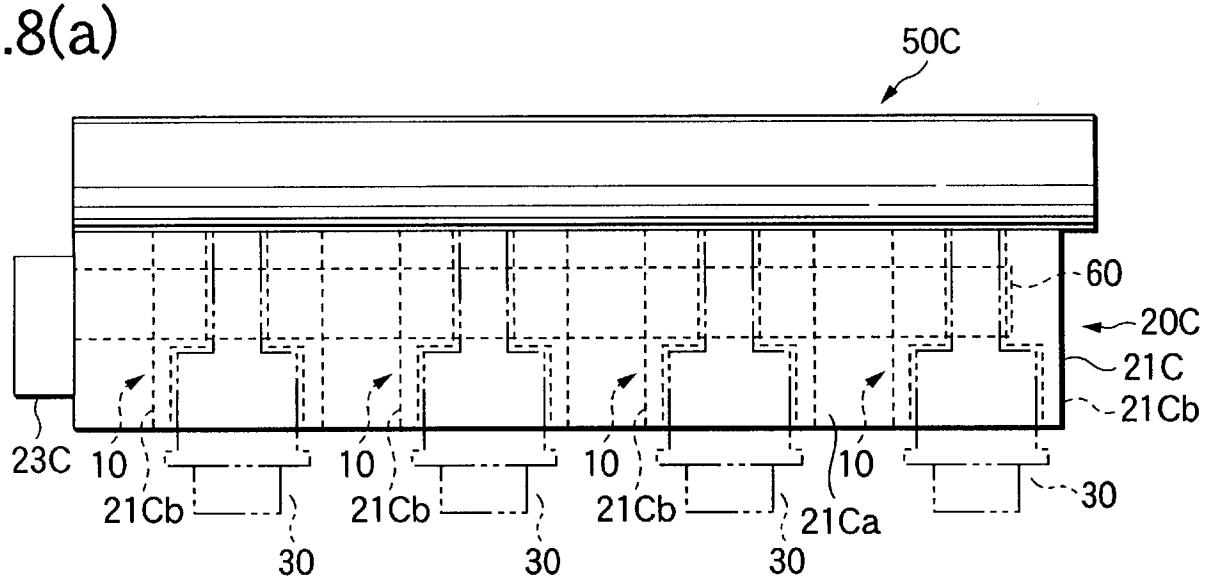
FIG. 8(*a*) is a plan view of the injector electric block body of another modified example, FIG. 8(*b*) is a plan view of the same injector electric block body, and FIG. 8(*c*) is a side view of the same injector electric block body.
Figure 8B:
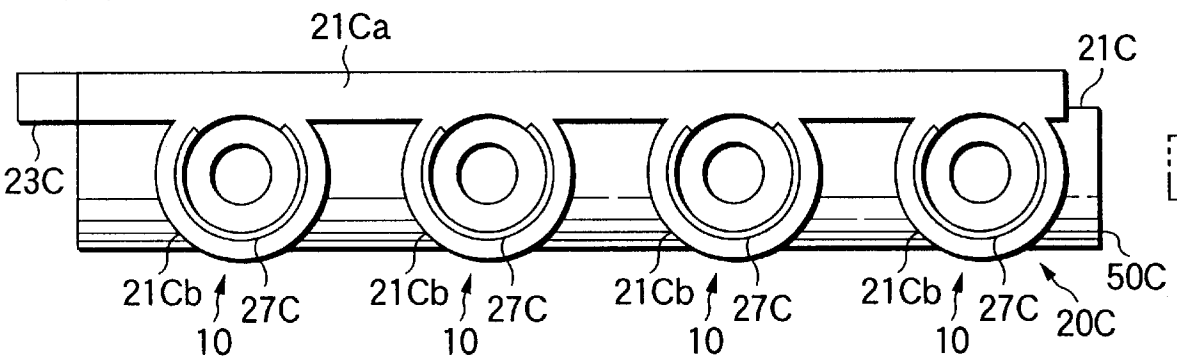
Figure 8C:
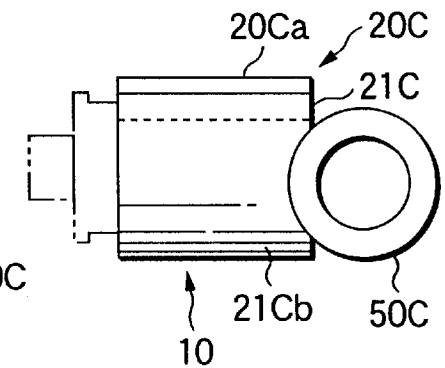
Figure 9:
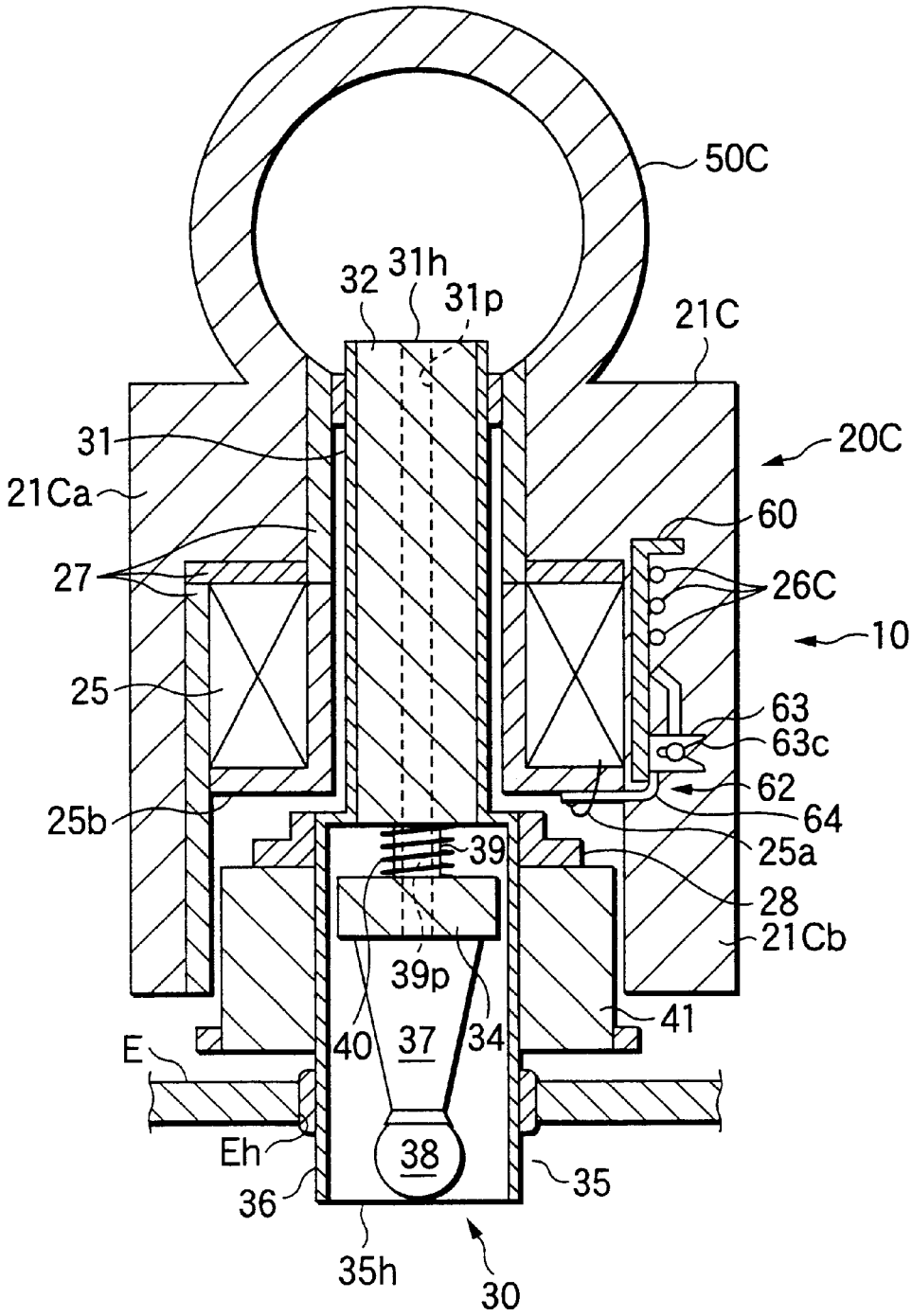
FIG. 9 is a sectional view of the same injector module as mentioned above.
Figure 10:
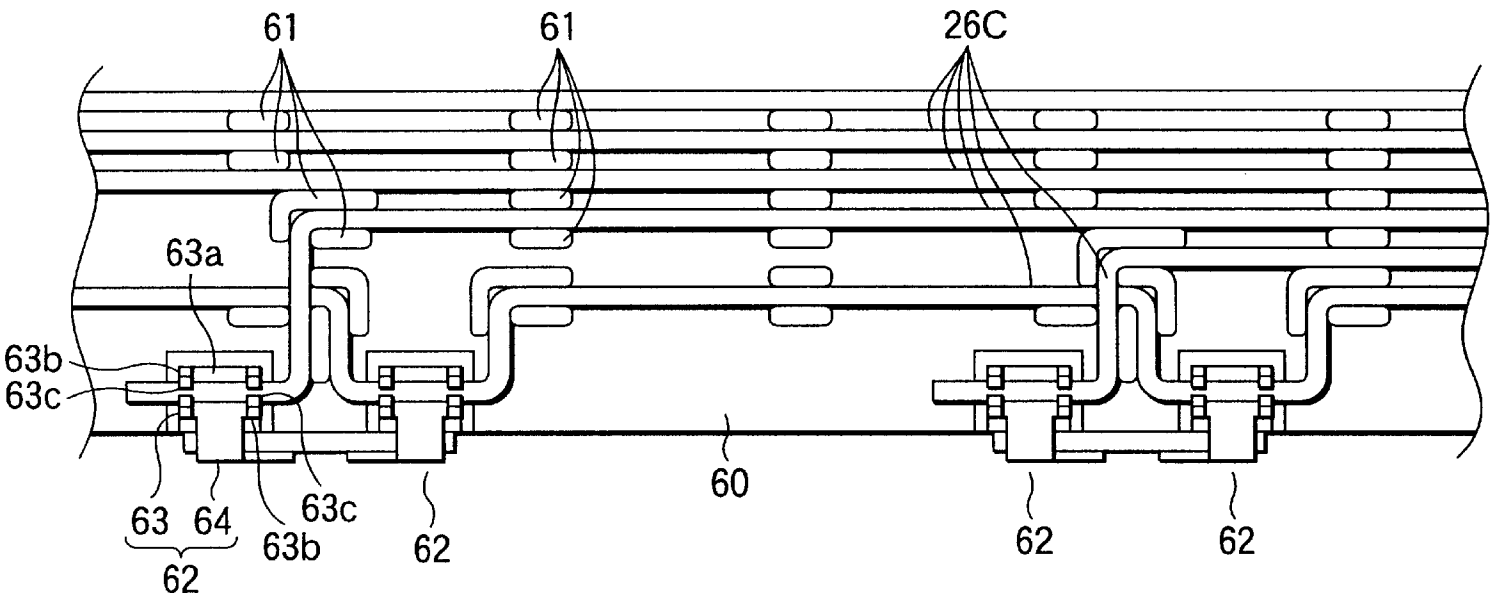
FIG. 10 is a front view showing the wiring to be applied to the same injector module as mentioned above.

As in the modified example shown in FIGS. 8 through FIG. 10, as the construction in which the electromagnetic coil parts 25 and wiring 26C are connected to each other, a construction may be employed in which coated single-core wires are used as wiring 26C and the terminals of the wires are pressure-welded to pressure-welding terminals 62 attached to the terminals of the winding wires 25*a* of the electromagnetic coil parts 25.

That is, explaining a point of difference of this modified example from the abovementioned embodiment, the following injector electric block body 20C is used in this modified example in place of the injector electric block body 20 in the abovementioned embodiment.

This injector electric block body 20C has an injector frame body 21C provided with plate-shaped parts 21Ca with roughly rectangle plate shapes so as to connect the columnar parts 21Cb at one-side parts of columnar parts 21Cb with rough columnar shapes provided for each injector mounting hole Eh. The columnar parts 21Cb are provided with components similar to the projecting columnar parts 21*b* in the abovementioned embodiment, and components with the same construction as those of the injector main bodies 30 are inserted and disposed for these, and these are provided with the same symbols and description thereof is omitted.

Inside the plate-shaped parts 21Ca, wiring 26C is installed and laid in a predetermined wiring pattern on substrate 60. The substrate 60 is formed into a roughly rectangle shape, and at the outer surface side thereof, a plurality of convex portions 61 for supporting the wiring 26C in the predetermined wiring pattern are formed. Then, the wiring 26C composed of coated single-core wires is sandwiched between the convex portions, whereby the wiring 26C is held in the predetermined wiring pattern.

A pair of pressure-welding terminals 62 are provided at each position of the lower edge of the substrate 60 corresponding to the columnar parts 21Cb.

The pressure-welding terminals 62 are formed from a conductive material such as metal or the like, and are provided with pressure-welding portions 63 for holding the wiring 26C by pressure-welding and winding connecting portions 64 to which the winding wires 25*a* of the electromagnetic coil parts 25 are connected. The pressure-welding portion 63 is formed into a rough U shape by providing a pair of side plates on both sides of substrate portion 63*a,* and is attached to the substrate 60 by closely adhering the outer surface of the substrate portion 63*a* to the outer surface lower edge of the substrate 60. Furthermore, slit-shaped pressure-welding grooves 63*c* which can hold the wiring 26*c* by pressure-welding are formed in the side plates 63*b,* by press-fitting the terminals of the wiring 26C into the pressure-welding grooves 63*c,* the terminals of the wiring 26C are held by means of pressure-welding to the pressure-welding portions 63. The winding connecting portions 64 are formed into band shapes extended from the substrate portions 63*a* of the pressure-welding portions 63 to the lower sides of the electromagnetic coil parts 25. Then, the winding wires 36*a* of the electromagnetic coil parts 25 are drawn out to the winding connecting portions 64 and welded and electrically connected to the winding connecting portions 64 by means of fusing or the like.

Then, the wiring 26C is laid in a predetermined wiring pattern on the substrate 60, the terminals of the wiring 26C are pressure-welded and connected to the pressure-welding portions 63 of the pressure-welding terminals 62 provided at the lower edge of the substrate 60, and in a condition where the terminals of the winding wires 25*a* of the electromagnetic coil parts 25 are connected to the winding connecting portions 64 of the pressure-welding terminals 62, the wiring 26C and substrate 60 are insert-molded into the injector frame body 21C together with the electromagnetic coil parts 25 and others, whereby the injector electric block body 20C is formed.

At one-side ends of the plate-shaped parts 21Ca of this injector electric block body 20C, connector parts 23C having connector terminals electrically connected to the wiring 26C are formed, and connectors of wire harness terminals drawn out from the engine control unit 1 can be connected to the connector parts 23.

In this modified example, the one-side portion with the plate-shaped part 21Ca formed of the outer circumferential core portion 27C corresponding to the outer circumferential core portion 27 is eliminated, and accordingly, a plate-shaped part 21Ca is provided in the vicinity of the columnar part 21Cb to make the construction at this section compact. Furthermore, even when the outer circumferential core portion 27C whose one-side portion is thus eliminated is used, a magnetic circuit is formed by other outer circumferential core portions 27C, so that there is no problem.

Furthermore, the injector frame body 21C of the injector electric block body 20C is integrally formed with the delivery pipe 50C, however, they may be separately formed.

As in this modified example, coated single-core wires are used as the wiring 26C, and the terminals of the wires are pressure-welded and connected to the pressure-welding terminals 62 attached to the ends of the winding wires 25*a* of the electromagnetic coil parts 25, whereby the wiring 26C can be easily connected to the pressure-welding terminals 62.

In this modified example, a mode in which wiring 26C is installed in the plate-shaped parts 21Ca provided at one side of each columnar part 21Cb is explained, however, as in the abovementioned embodiment, the wiring 26 may be installed in the plate-shaped parts 21*a* provided on the projecting columnar parts 21*b*.

Furthermore, although the wiring 26C is insert-molded inside the plate-shaped parts 21Ca, a construction may be employed in which the plate-shaped parts 21Ca are divided into two along the longitudinal direction for the main bodies and cover parts and the wiring 26C is housed between them. In this case, coated conductors may be used for the wiring 26C.

Figure 11:
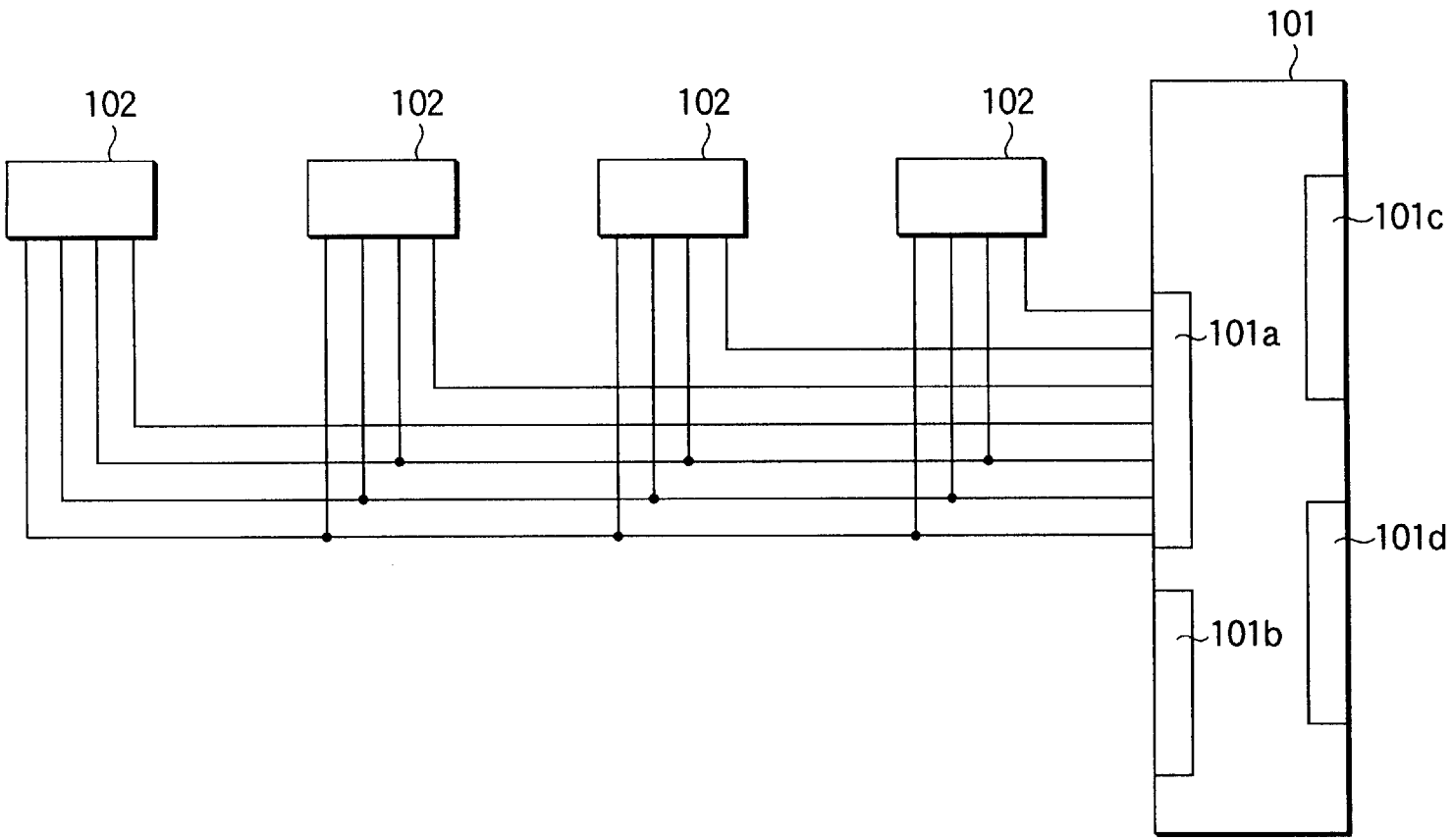
FIG. 11 is a block diagram showing the electrical construction of the engine control system of the embodiment.
Figure 12:
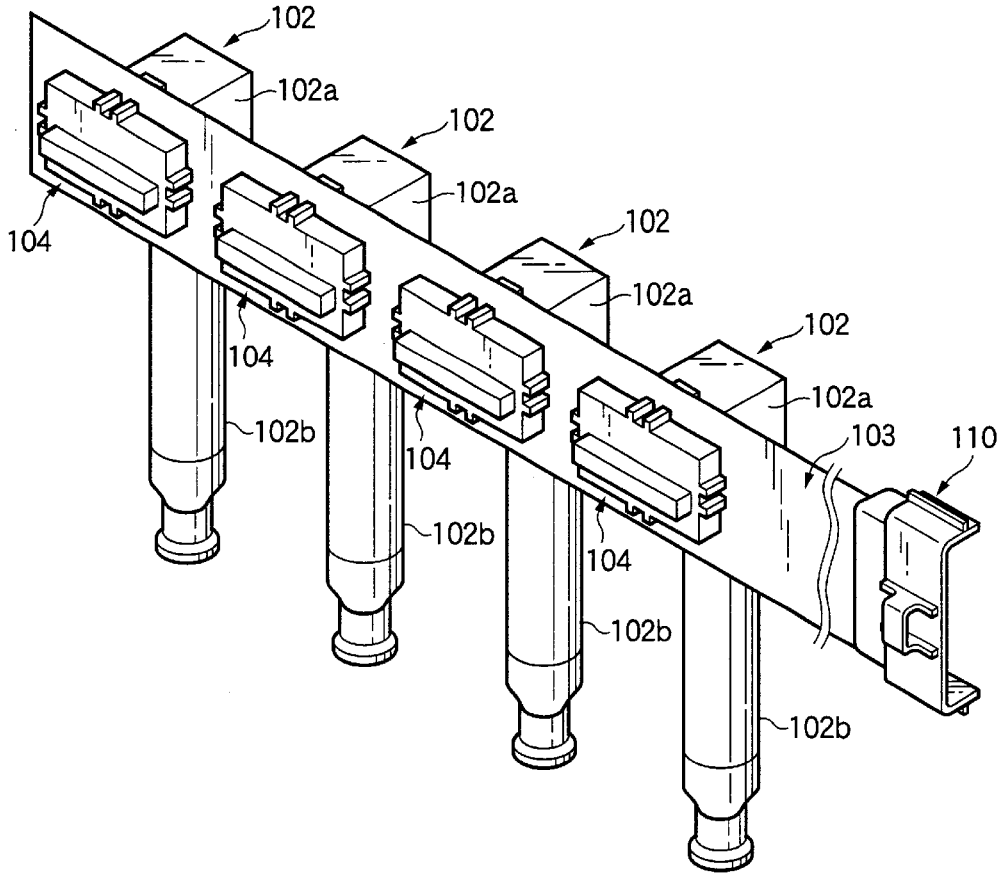
FIG. 12 is a perspective view showing the ignition coil device module relating to the embodiment.

Further, FIG. 11 is a schematic drawing showing an example of an engine control system to which this ignition coil device module is applied, wherein engine control unit 101 (so-called EFI-ECU or the like) is connected to ignition coil devices 102 (igniter-combined ignition coils) via input and output portion 101*a*, and connected to a power supply system including various sensors and batteries provided at the engine body side and various parts such as junction blocks and the like inside a vehicle, and further connected to injectors. The engine control unit 101 is constructed so that the ignition timing of the ignition coil devices 102 and the fuel injection amount from the injectors are controlled based on various detection signals from the sensors.

In this engine control system, since a 4-cylinder engine is assumed, four ignition coil devices 102 are provided, however, the number of ignition coil devices may be properly changed depending on the number of cylinders of the engine. The four wires to be connected to each ignition coil device 102 include a wire for applying a primary voltage, a wire for inputting ignition timing signals to a switching device, a ground wire, and a wire for outputting detection signals of operating conditions of the ignition coil devices 102. Depending on the control method by the engine control system, proper changes such as elimination or the like (for example, elimination of the wire for outputting detecting signals of the operating conditions of the ignition coil devices 102) are added to these wires.

This ignition coil device module is constructed so that electrical connecting portions between these ignition coil devices 102 and engine control unit 1 and the ignition coil devices 102 are unified with each other, and as shown in FIG. 12 through FIG. 15, mainly comprised of a plurality of ignition coil devices 102; flexible printed board 103 as an example of the flexible wiring having flexibility for electrically connecting the ignition coil devices 102 and the input and output portion 1*a* of the engine control unit 101 to each other; and a plurality of fixed cover members 104 for attaching and fixing the ignition coil devices 102 to predetermined positions of the flexible printed board 103 in a condition where the wiring circuits of the flexible printed board 103 side and the wiring circuits of the ignition coil devices 102 side are connected to each other.

Figure 16:
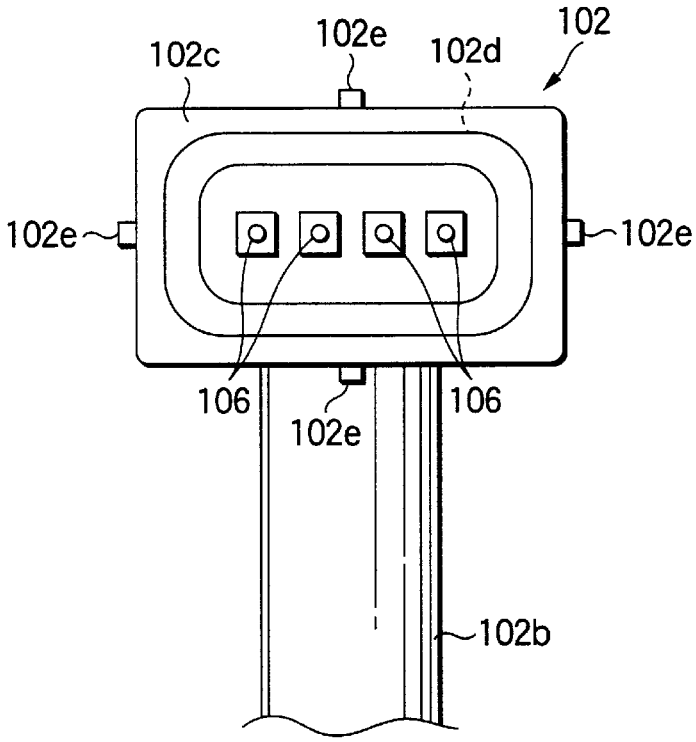
FIG. 16 is a principal portion front view of the ignition coil device.
Figure 17:
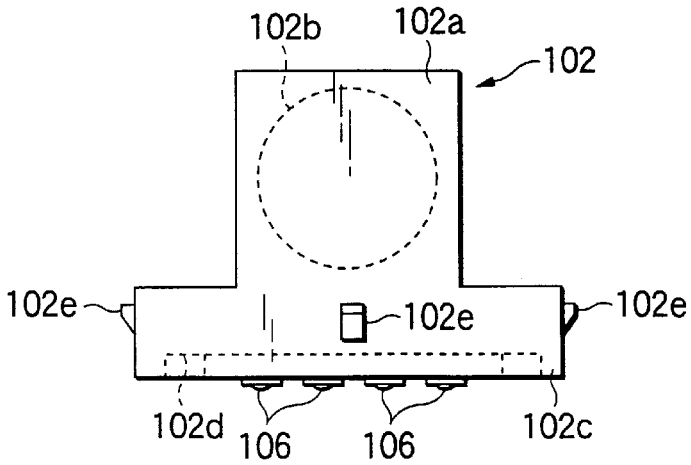
FIG. 17 is a plan view of the same.
Figure 18:
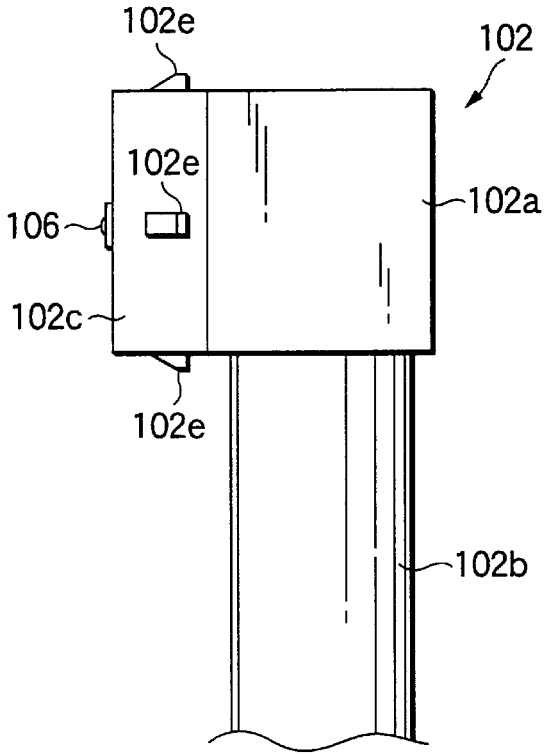
FIG. 18 is a right side view of FIG. 6.

The ignition coil devices 102 are, as shown in FIG. 16 through FIG. 18, constructed so that cylindrical connecting portions 102*b* which are smaller in diameter than coil bodies 102*a* and can be inserted into plug holes of the engine side are provided downward from the coil bodies 102*a* in which secondary high voltage generating ignition coils and switching devices are installed.

On one-side surface of each coil body 102*a*, connection surface base portions 102*c* at which connecting terminals 106 for input to and output from internal wiring circuits are arranged and exposed in parallel at predetermined pitches are projectedly formed.

At the projecting end face of the connection surface base portion 102*c*, circumferential annular concave groove 102*d* is formed to surround the outside of each connecting terminal 106, and at four corners of the outer circumferential surface of the connection surface base portion 102*c*, latching projecting portions 102*e* are projectedly provided, respectively.

Figure 19:
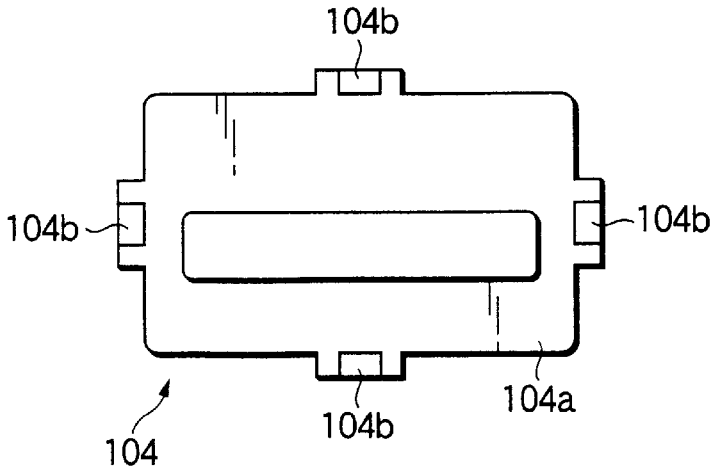
FIG. 19 is a front view of the fixed cover member.
Figure 20:
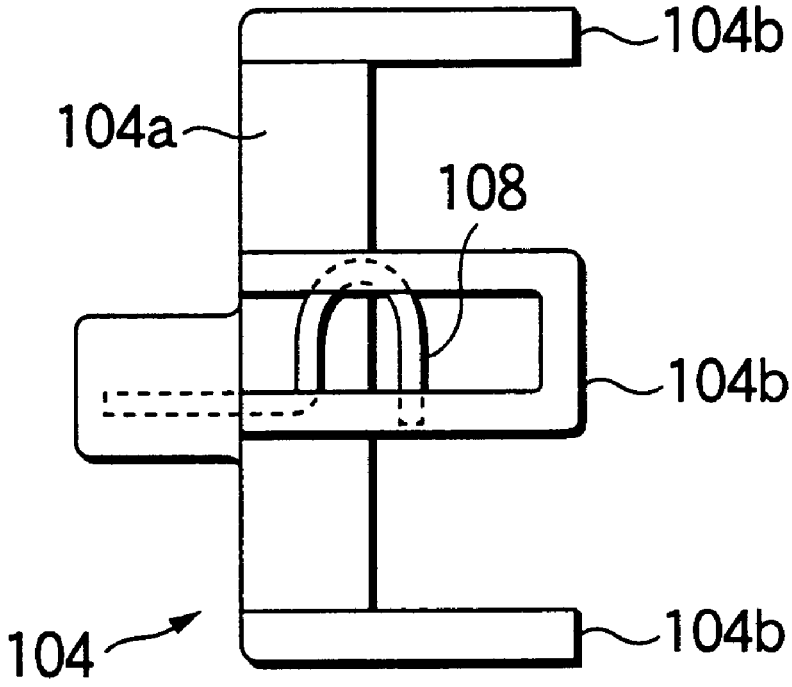
FIG. 20 is a right side view of the same.

The fixed cover members 104 are, as shown in FIG. 19 and FIG. 20, molded from a hard resin or the like which has flexibility, and provided with rectangle main bodies 104*a* corresponding to the projecting end faces of the connection surface base portions 102*c*, and at four corners of the outer circumferential surfaces of the main bodies 104*a*, U-shaped latching portions 104*b* are provided corresponding to the latching projecting portions 102*e* of the connection surface base portions 102*c* so as to project in the directions to connection surface base portions 102*c*.

Figure 13:
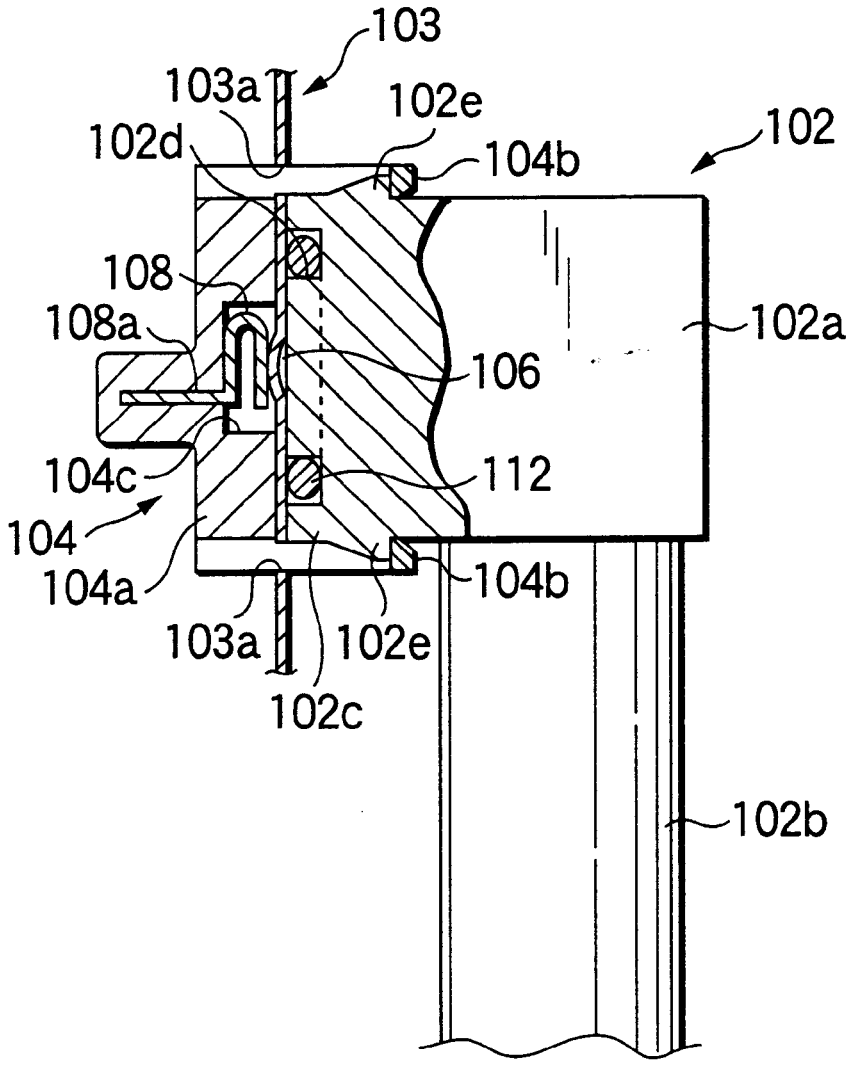
FIG. 13 is a partial sectional side view of the same.
Figure 14:
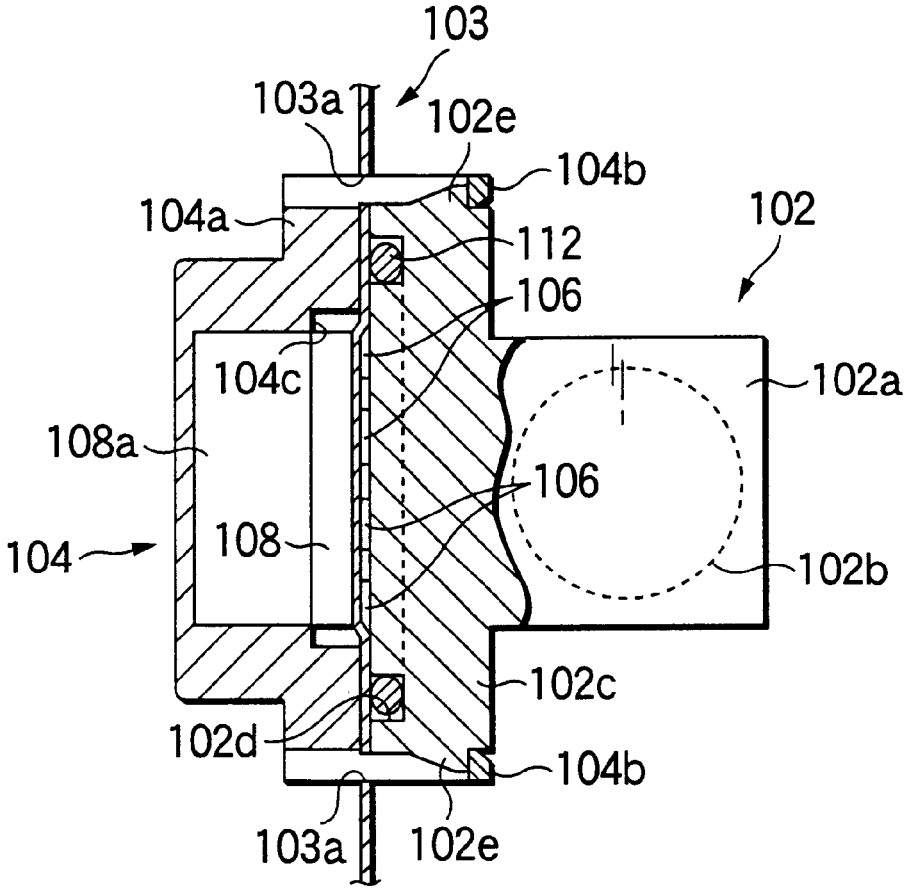
FIG. 14 is a partial sectional plan view of FIG. 3.
Figure 15:
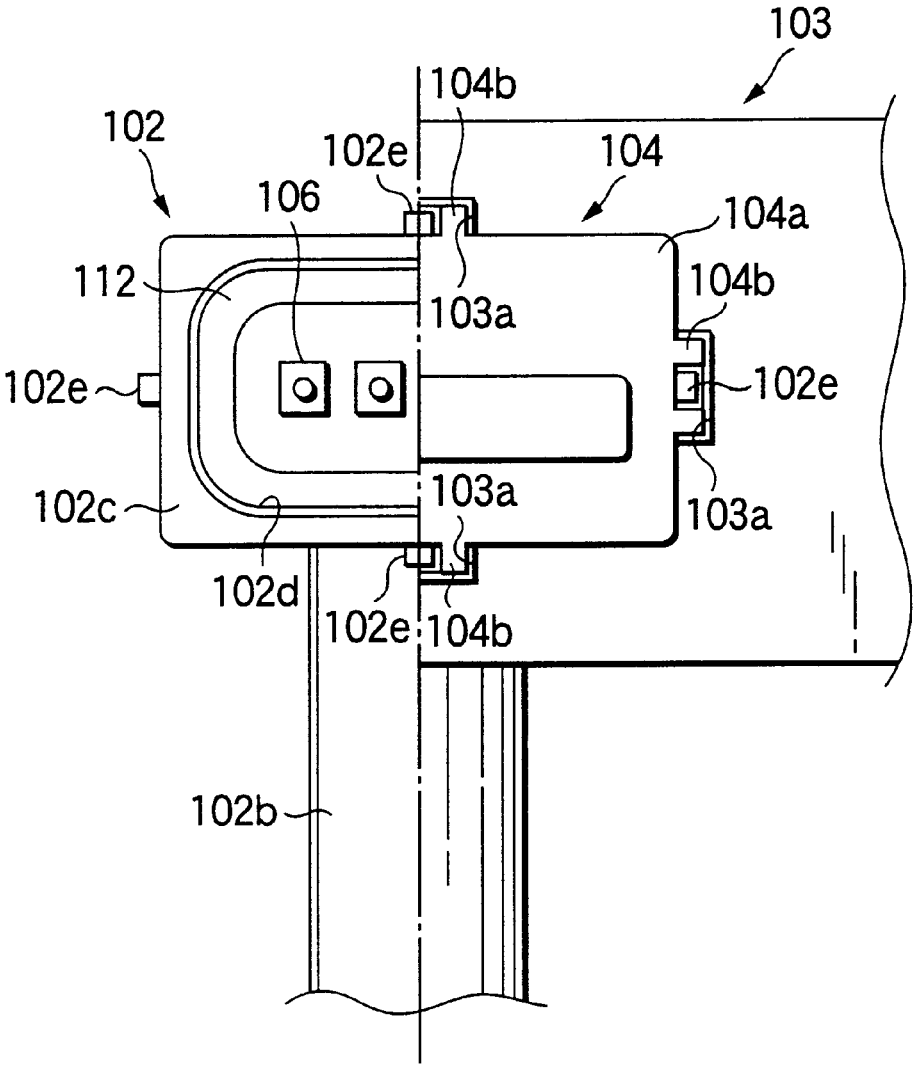
FIG. 15 is a partially omitted front view of FIG. 3.

Then, as shown in FIG. 13 through FIG. 15, in a condition where the flexible printed board 103 is interposed between the projecting end faces of the connection surface base portions 102*c* and the main bodies 104*a* of the fixed cover members 104, the main bodies 104*a* are pressure-welded to the projecting end face sides, whereby the latching portions 104*b* and latching projecting portions 102*e* are latched with each other in a manner enabling them to unlatch due to elastic deformation of the latching portions 104*b*.

Furthermore, in order to make this latching smooth, inclined latching guide surfaces are properly formed on the latching projecting portion 102*e* and latching portions 104*b*.

At the opposing surfaces of the main bodies 104*a* of the fixed cover members 104 with respect to the connecting terminals 106 of the connection surface base portions 102*c*, spring housing grooves 104*c* which are long in the parallel-arrangement direction are formed, and in the spring housing grooves 104*c*, pressing elastic materials 108 formed of spring materials that are positioned inside the spring housing grooves and bent into rough U-shapes are held. In this embodiment, the base portions 108*a* of the pressing elastic materials 108 are held to be buried in the fixed cover members 104.

The pressing elastic materials 108 are formed so as to project from the spring housing grooves 104*c* in their natural conditions as shown in FIG. 20, and on the other hand, when the fixed cover members 104 are attached and fixed to the connection surface base portions 102*c*, as shown in FIG. 13 and FIG. 14, the pressing elastic materials 108 are elastically deformed in a contracting condition within the spring housing grooves 104*c*, and due to the elastic forces, presses the sandwiched and held flexible printed board 103 against the connecting terminals 106.

Predetermined wiring conductors are wired on the flexible printed board 103, and the insulating films opposed to the connecting terminals 106 of the connection surface base portions 102*c* at the attaching and fixing positions of the ignition coil devices 102 are separated and the wiring conductors at portions corresponding to the connecting terminals 106 are exposed, and corresponding to the latching portions 104*b* of the fixed cover members 104 to be attached and fixed to the connection surface base portions 102*c* while sandwiching the flexible printed board 103, latching portion insertion holes 103*a* are made in the flexible printed board 103.

At this time, the pitches of electrical connection between the ignition coil devices 102 attached to the flexible printed board 103 are set to be slightly longer than the provision pitches of the ignition coil devices 102 to the engine side.

To one-side end of the flexible printed board 103, connector 110 for connection to the input and output portion 101*a* of the engine control unit 101 is attached.

In a condition where O-rings as examples of annular sealing members are attached to the concave grooves 102*d* of the connection surface base portions 102*c*, each ignition coil device 102 is disposed at one-side surface of the attaching position of the flexible printed board 103, and the fixing cover member 104 is pressed against the connection surface base portion 102*c* from the other side surface, whereby the pressing elastic material 108 elastically deforms, and an attached and fixed condition is obtained where each latching portions 104*b* and each latching projecting portions 102*e* are latched with each other.

By this fixed condition, the connecting terminals 106 of each ignition coil device 102 side and wiring conductors of the flexible printed board 103 side are pressure-welded and connected to each other, and the outsides of the electrical connecting portions are surrounded and sealed by the O-rings 112.

The embodiment is constructed as mentioned above, and since the ignition coil devices 102 are electrically connected to each other by the flexible printed board 103 and unified with each other, assembly to the engine side can be carried out by only attaching the ignition coil devices 102 to the engine side and connecting the connectors 110 to the engine control unit 101 side. Therefore, different from the conventional example, connector-connection for each ignition coil device attached to the engine side is not necessary, so that assembly becomes easy and assembly work efficiency is improved.

Furthermore, since the flexible printed board 103 is used as the wiring for the ignition coil devices 102, this is advantageous in terms of reduction in weight in comparison with the structure using wire harnesses formed of electric wire bundles.

Since the outsides of the connecting portions between the connecting terminals 106 of each ignition coil device 102 side and the wiring conductors of the flexible printed board 103 side are surrounded and sealed by O-rings 112, water entrance to the electrical connecting portions is effectively prevented.

Furthermore, by the elastic forces of the pressing elastic materials 108, the exposed portions of the wiring conductors of the flexible printed board 103 side are pressed against the connecting terminals 106, electrical connecting conditions are more stably secured.

In addition, a system is employed in which the flexible printed board 103 is sandwiched and fixed by fixing the fixed cover members 104 to the connection surface base portions 102*c* of the ignition coil devices 102 and the connecting terminals 106 and wiring conductors of the flexible printed board 103 are electrically connected to each other by this sandwiching fixation, and this system has an advantage whereby assembly of the ignition coil device module can be easily carried out.

Furthermore, the pitches of electrical connection of the connecting terminals to the flexible printed board 103 are set to be slightly longer than the provision pitches of the ignition coil devices 102, so that an advantage is also obtained whereby deviations and the like due to manufacturing tolerances and thermal expansion of the engine or the like can be effectively absorbed by the allowance in the flexible printed board 103.

Then, since the connecting terminals 106 are connected by the flexible printed board 103 with flexibility, and in addition, the connecting pitches are set to be longer than the provision pitches of the ignition coil devices 102, the ignition coil device module can be commonly used for engines if the engines are types whose provision pitches are shorter than the connecting pitches and which have the same number of cylinders, whereby applicability of the module for general purposes is also improved.

Furthermore, the flexible printed board 103 and fixed cover members 104 are installed inside a cylinder head cover made from a resin or the like, and if the flexible printed board 103 and fixed cover members 104 are installed in advance, by fixing the coil bodies 102*a* of the ignition coil devices 102 to the fixed cover members 104, assembly of the ignition coil devices 102 to the cylinder head is completed, and this further improves assembly work efficiency.

In the abovementioned embodiment, a structure using the flexible printed board 103 as flexible wiring is shown, however, a structure using other flat cables and a plurality of electric wires may be employed.

Also, a structure using the O-rings 112 as annular sealing members is shown, however, annular packing materials and the like may be used.

[Effects of the Invention]

As mentioned above, according to the injector module described in Aspect 1 of the invention, the module comprises an injector electric block body formed so that, inside an injector frame body having injector main body housing holes made in it at positions corresponding to injector mounting holes of the engine body side, electromagnetic coils are installed and wound around the inner circumferences of the injector main body housing holes and wiring for connection to the electromagnetic coil parts is installed; valve parts which are formed to be columnar and adjust the injection timing of fuel from fuel injection orifices; and injector main bodies, which are provided with columnar parts linearly provided in succession to the valve parts to feed fuel supplied from fuel intakes to the valve parts, and movable magnetic bodies that can reciprocate between predetermined open and close positions for opening and closing the valve parts and are pressed toward the close positions, wherein the injector main bodies are inserted into the injector main body housing holes in a posture in which the movable magnetic bodies can move to the open positions against the pressing forces due to excitation of the electromagnetic coil parts, and can move to the close positions due to the pressing forces in accordance with non-excitation of the electromagnetic coil parts. Therefore, connection of the harness terminal connectors to each injector in the vicinity of the engine body as in the conventional example is not necessary, and therefore, assembly work efficiency to the engine body side and waterproofness are excellent.

Furthermore, different from the conventional example, the harness terminals and injectors are not connector-connected by using harnesses formed of electric wire bundles for wiring members between the engine control unit and injectors, so that reduction in weight can be achieved, accordingly.

As described in Aspect 2, fixing core portions are provided at the centers of the electromagnetic coil parts, movable magnetic bodies are provided to be extensions of the fixing core portions, auxiliary core portions are provided around the outer circumferences of the movable magnetic bodies, and outer circumferential core portions are provided around the outer circumferences of the electromagnetic coil parts, whereby a magnetic circuit is formed in which magnetic fluxes generated by power supply to the electromagnetic coil parts pass through the fixing core portions, movable magnetic bodies, auxiliary core portions, and outer circumferential core portions, and then reach the fixing core portions again. Thereby, the magnetic flux density at the movable magnetic bodies becomes high, the movable magnetic bodies can be attracted to the open positions by greater attraction forces, and therefore, the opening and closing operations can be more securely carried out.

Furthermore, as described in Aspect 3, when non-magnetic bodies are interposed between the fixing core portions and outer circumferential core portions, magnetic fluxes that have come out from the fixing core portions are prevented from directly entering the auxiliary core portions without passing through the movable magnetic bodies, and it becomes possible to make more magnetic fluxes pass through, and accordingly, the movable magnetic bodies can be more securely moved to the open positions by means of excitation of the electromagnetic coil parts.

Furthermore, as described in Aspect 4, in place of or in addition to the outer circumferential core portions provided around the outer circumferences of the electromagnetic coil parts, inter-injector core portions are provided between the injector main body housing holes of the injector frame body to form a magnetic circuit in which magnetic fluxes generated by power supply to the electromagnetic coil parts pass through the adjacent inter-injector core portions, whereby the magnetic flux density at the movable magnetic bodies increases, the movable magnetic bodies can be attracted to the open positions by greater forces, and therefore, the opening and closing operations can be more securely carried out.

As described in Aspect 5, if the injector electric block body is unified with the delivery pipe, assembly of the block body and the pipe to the engine body can be more easily carried out.

Furthermore, as described in Aspect 6, the winding terminals of the electromagnetic coil parts are connected to the pressure-welding terminals, and coated single-core wires are used for the wiring and the ends of the wires are pressure-welded and connected to the pressure-welding terminals, whereby the wiring can be easily connected to the pressure-welding terminals.

Furthermore, according to the injector electric block body of an injector module described in Aspect 7 of the invention, a plurality of injector parts are provided in accordance with the combustion chambers of the engine, and fuel injection control of the injector parts is made by an engine control unit, wherein said injector electric block body comprises an injector frame body having injector main body housing holes made in it at positions corresponding to injector mounting holes of the engine body side, electromagnetic coil parts for opening and closing valve parts of injector main bodies inserted into the injector main body housing holes, and wiring for connection to the electromagnetic coil parts that are installed inside the injector frame body. Therefore, connection of connectors of harness terminals to each injector in the vicinity of the engine body as in the conventional example is not necessary, so that assembly work efficiency to the engine body side and waterproofness are excellent, and reduction in weight can be achieved as a result of the unnecessary connectors.

According to the injector main bodies described in Aspect 8, the main bodies are formed into roughly columnar shapes with fuel intakes at one-side end and fuel injection orifices at the other side ends, and comprise valve parts which are provided at the fuel injection orifice sides to adjust the injection timing of fuel supplied through the fuel intakes; and movable magnetic bodies which can reciprocate between predetermined open and close positions for opening and closing the valve parts and are pressed toward the close positions, and move to the open positions due to excitation of the electromagnetic coil parts provided at the injector mounting hole sides of the injector electric block body side against the pressing forces to open the valve parts. Therefore, connection of harness terminal connectors to each injector as in the conventional example is not necessary, and therefore, assembly work efficiency to the engine body side and waterproofness are excellent, and also, as a result of the connectors being made unnecessary, reduction in weight can be achieved.

Further, as described above, according to the ignition coil device module of the invention, ignition coil devices are electrically connected to each other at predetermined pitches by flexible wiring with flexibility and unified with each other, and ignition control is made through the flexible wiring, and assembly to the engine side is completed by only attaching the ignition coil devices to the engine side and connecting the ends of the flexible wiring to the engine control unit side. Therefore, different from the conventional example, connector-connection to each ignition coil device attached to the engine side is not necessary, so that assembly becomes easy and assembly work efficiency can be improved.

If a structure using a flexible printed board as flexible wiring is employed, this has an advantage whereby reduction in weight can be achieved in comparison with the structure using wire harnesses formed of electric wire bundles.

Furthermore, if a structure in which the pitches of electrical connection of the ignition coil devices to the flexible wiring are set to be longer than the provision pitches of the ignition coil devices to the engine or the like is employed, deviations due to manufacturing tolerances and thermal expansions of the engine or the like can be effectively absorbed by allowances in the flexible wiring, and the ignition coil device module can be commonly used for engines if the engines are types whose provision pitches are shorter than the connection pitches and which have the same number of cylinders.

Furthermore, if a structure in which connection surface base portions at which electrical connecting terminals are exposed are provided at one surface of each ignition coil device, fixed cover members are provided to be fixed in a detachable manner to the connection surface base portions so as to surround the outsides of the connecting terminals at the connection surface base portions, and the fixed cover members are fixed to the connection surface base portions, whereby flexible wiring is sandwiched and fixed between the fixed cover members and connection surface base portions, wiring conductors at portions in the flexible wiring thus sandwiched and fixed corresponding to the connecting terminals of the connection surface base portions are exposed, and the connecting terminals and wiring conductors are electrically connected to each other by the sandwiching fixation, assembly of the ignition coil device module can be easily carried out.

Furthermore, if a structure is employed in which annular sealing members are provided to surround the outsides of the connecting portions between the connecting terminals and wiring conductors are provided between the connection surface base portions and fixed cover members, water entrance to the electrical connecting portions between the connecting terminals and wiring conductors can be effectively prevented.

Furthermore, if a structure is employed in which pressing elastic materials are provided on the fixed cover members for pressing the exposed portions of the wiring conductors against the connecting terminals when the fixed cover members are fixed to the connecting terminals to sandwich and fix the flexible wiring, electrical connecting conditions of the connecting terminals and wiring conductors can be more stably obtained.

Furthermore, if a structure provided with a cylinder head cover in which the flexible wiring and fixed cover members are installed is employed, assembly work efficiency is further improved.

What is claimed is:

1. An injector module provided with a plurality of injector parts corresponding to combustion chambers of an engine, where fuel injecting control of said injector parts is made by an engine control unit, comprising:

an injector electric block body formed so that, inside an injector frame body provided with injector main body housing holes perforating through said bodies at positions corresponding to injector mounting holes at said engine body side, electromagnetic coil parts are installed so as to be wound around the inner circumferences of the injector main body housing holes, and wires for connection to said electronic coil parts are installed; and injector main bodies which are formed into roughly columnar shapes and comprise valve parts for adjusting the timing of fuel injection from fuel injecting orifices, columnar parts which are linearly provided in succession to the valve parts to feed fuel supplied from fuel intakes to the valve part, movable magnetic bodies that is capable to reciprocate between predetermined open and close positions for opening and closing said valve parts and are pressed toward the close position; wherein said injector main bodies are inserted into said injector main body housing holes in a posture in which the movable magnetic bodies are movable to the open positions in accordance with excitation of said electromagnetic coil parts against the pressing forces and movable to the close positions due to the pressing forces in accordance with non-excitation of said electromagnetic coil parts.

2. The injector module according to claim 1, wherein fixing core portions are provided at the centers of said electromagnetic coils, said movable magnetic bodies are disposed to be extensions of said fixing core portions, auxiliary core portions are provided around the outer circumferences of said movable magnetic bodies, and outer circumferential core portions are provided around the outer circumferences of said electromagnetic coil parts, wherein a magnetic circuit is formed so that magnetic fluxes generated by power supply to said electromagnetic coil parts pass through said fixing core portions, movable magnetic bodies, auxiliary core portions, and outer circumferential core portions, and reach said fixing core portions again.

3. The injector module according to claim 2, wherein nonmagnetic materials are interposed between said fixing core portions and outer circumferential core portions.

4. The injector module according to claim 2, wherein in place of or in addition to said outer circumferential core portions provided around the outer circumferences of said electromagnetic coils, inter-injector core portions are provided between said injector main body housing holes made in said injector frame body, wherein a magnetic circuit is formed so that magnetic flux generated by power supply to said electromagnetic coil parts pass through said adjacent inter-injector core portions.

5. The injector module according to claim 1, wherein said injector electric block body is unified with a delivery pipe.

6. The injector module according to claim 1, wherein pressure-welding terminals are connected to the winding ends of said electromagnetic coil parts; and coated single-core wires are used for wiring and the ends of said wires are pressure-welded to said pressure-welding terminals.

7. An injector electric block body of an injector module, in which a plurality of injector parts are provided in accordance with combustion chambers of an engine and fuel injecting control at said injector parts is made by an engine control unit, comprising:

an injector frame body with injector main body housing holes made at positions corresponding to injector mounting holes at said engine body side;

electromagnetic coil parts which are disposed so as to be wound around the inner circumferences of said injector main body housing holes to electromagnetically open and close the valve parts of said injector main bodies to be inserted inside the injector main body housing holes; and wires for connection to said electromagnetic coil parts, which are installed inside said injector frame body.

8. Injector main bodies of an injector module in which a plurality of injector parts are provided in accordance with combustion chambers of an engine and fuel injecting control of said injector parts is made by an engine control unit, wherein said injector main bodies are formed into roughly columnar shapes in each of which a fuel intake is formed at one side and a fuel injecting orifice is formed at the other side, said injector main bodies comprising:

valve parts which are provided at the fuel injecting orifice sides to adjust the injection timing of fuel supplied from said fuel intakes; and movable magnetic bodies which is capable to reciprocate between predetermined open positions and close positions for opening and closing said valve parts, and are pressed toward the close positions, and opens said valve parts by moving to the open positions against the pressing forces by use of excitation at said electromagnetic coils parts provided at the injector mounting hole sides of said injector electric block body side.

9. An ignition coil device module comprising:

ignition coil devices corresponding to a plurality of combustion chambers of an engine, and an engine control unit for ignition control of said ignition coil devices, wherein said ignition coil devices are electrically connected to each other at predetermined pitches by a flexible wiring with flexibility and unified with each other, and the ignition control is made via said flexible wiring.

10. The ignition coil device module according to claim 9, wherein said flexible wiring is a flexible printed board.

11. The ignition coil device module according to claim 9, wherein the pitches of electrical connection of said ignition coil devices to said flexible wiring are made longer than the provision pitches of said ignition coil devices for said engine.

12. The ignition coil device module according to claim 9, comprising:

at one surface of each of said ignition coil device, connection surface base portions at which said electrical connecting terminals are exposed, and fixed cover members to be fixed in a detachable manner to each connection surface base portion so as to surround the outsides of said connecting terminals; wherein by fixing said fixed cover members to said connection surface base portions, said flexible wiring is sandwiched and fixed between said fixed cover members and connection surface base portions, wiring conductors at portions in said flexible wiring corresponding to said connecting terminals of said connection surface base portions are formed to be exposed, and said connecting terminals and wiring conductors are electrically connected to each other by the sandwiching fixation.

13. The ignition coil device module according to claim 12, comprising:

annular sealing members provided between said connection surface base portions and said fixed cover members so as to surround the outsides of said connecting portions between said connecting terminals and wiring conductors.

14. The ignition coil device module according to claim 12, comprising:

pressing elastic materials for pressing said exposed portions of said wiring conductors to said connecting terminals, when said fixed cover members are fixed to said connecting terminals to sandwich and fix said flexible wiring.

15. The ignition coil device module according to claim 12, comprising:

a cylinder head cover in which said flexible wiring and fixed cover members are installed.

* * * * *